US010967337B2

(12) United States Patent
Grimm et al.

(10) Patent No.: US 10,967,337 B2
(45) Date of Patent: Apr. 6, 2021

(54) AGGREGATE ATTRITION SYSTEMS, METHODS, AND APPARATUS

(71) Applicant: Superior Industries, Inc., Morris, MN (US)

(72) Inventors: Lafe Grimm, Hancock, MN (US); Travis Thooft, Cyrus, MN (US)

(73) Assignee: Superior Industries, Inc., Morris, MN (US)

( * ) Notice: Subject to any disclaimer, the term of this patent is extended or adjusted under 35 U.S.C. 154(b) by 243 days.

(21) Appl. No.: 15/600,194

(22) Filed: May 19, 2017

(65) Prior Publication Data

US 2017/0333851 A1 Nov. 23, 2017

Related U.S. Application Data

(60) Provisional application No. 62/344,144, filed on Jun. 1, 2016, provisional application No. 62/339,658, filed on May 20, 2016.

(51) Int. Cl.

| | |
|---|---|
| ***B01F 7/22*** | (2006.01) |
| ***B01F 3/12*** | (2006.01) |
| ***B02C 17/16*** | (2006.01) |
| ***B08B 1/00*** | (2006.01) |
| ***B01F 5/00*** | (2006.01) |
| ***B01F 7/16*** | (2006.01) |

(52) U.S. Cl.

CPC ..... *B01F 3/1221* (2013.01); *B01F 3/12* (2013.01); *B01F 5/00* (2013.01); *B01F 7/16* (2013.01); *B01F 7/22* (2013.01); *B02C 17/16* (2013.01); *B02C 17/163* (2013.01); *B08B 1/00* (2013.01); *B02C 2017/165* (2013.01)

(58) Field of Classification Search

CPC ..... B01F 7/22
USPC ..... 366/329.1, 329.2, 331, 249–252
See application file for complete search history.

(56) References Cited

U.S. PATENT DOCUMENTS

| | | | | |
|---|---|---|---|---|
| 2,896,925 | A * | 7/1959 | Place | B01F 7/00475 366/331 |
| 3,446,442 | A | 5/1967 | Carter | |
| 3,924,835 | A * | 12/1975 | Hohnfeld | B01F 7/045 366/293 |
| 4,098,465 | A | 7/1978 | Meller et al. | |
| 4,108,385 | A | 8/1978 | Funk | |
| 4,434,942 | A | 3/1984 | Cardini | |
| 4,468,130 | A | 8/1984 | Weetman | |
| 4,533,464 | A | 8/1985 | Smith et al. | |
| 4,813,617 | A | 3/1989 | Knox, Jr. et al. | |

(Continued)

FOREIGN PATENT DOCUMENTS

| | | |
|---|---|---|
| KR | 101700662 B1 | 1/2017 |
| WO | 9527563 A1 | 10/1995 |

OTHER PUBLICATIONS

Az Fab; Vertical Durability Cell; brochure; pp. 1-2; admitted prior art; Tucson, Arizona.

(Continued)

*Primary Examiner* — David L Sorkin
(74) *Attorney, Agent, or Firm* — Todd R. Fronek; Larkin Hoffman Daly & Lindgren Ltd.

(57) ABSTRACT

Attrition mills and propeller shaft assemblies therefor are described having features for enhanced installation and maintenance. Some embodiments include propellers having enhanced material processing characteristics.

27 Claims, 18 Drawing Sheets

(56) References Cited

U.S. PATENT DOCUMENTS

| | | | |
|---|---|---|---|
| 5,328,105 | A | 7/1994 | Sims et al. |
| 6,109,449 | A | 8/2000 | Howk et al. |
| 7,168,641 | B2 | 1/2007 | Filgueiras |
| 8,695,804 | B2 | 4/2014 | Bennington, II et al. |
| 2005/0221246 | A1 | 10/2005 | Drinkwater et al. |
| 2005/0242218 | A1 | 11/2005 | Nakano et al. |
| 2006/0176771 | A1 | 8/2006 | Adams |
| 2011/0309174 | A1 | 12/2011 | Rubenstein et al. |

OTHER PUBLICATIONS

Julian B. Fasano and Mark Reeder; Viscous and Geometric Effects on Fluid Motion and Flow; AIChE 2002 Annual Meeting; Nov. 3-8, 2002; Indianapolis, Indiana; pp. 1-28.

Eagle Iron Works; Attrition Mill; brochure; 2005; pp. 1-3; Des Moines, Iowa.

Floatex Separations Ltd.; Attrition Scrubber; brochure; admitted prior art; pp. 1-4; Northhamptonshire, United Kingdom.

Flsmidth Minerals; Wemco Attrition Machines; brochure; 2007; pp. 1-6; Salt Lake City, Utah.

James Steffe; Rheological Methods in Food Process Engineering; Chapter 10—Mixing and Agitation; book; Freema Press; 1996; pp. 287-304; East Lansing, Michigan.

KPI-JCI ASTEC Companies; Attrition Cell Spec Sheet; May 2012; p. 1; Yankton, South Dakota.

Metso Corporation; Attrition Scrubbers; brochure; 2012; pp. 1-4; Helsinki, Finland.

Mike Preston and Jeremy Tatarzyn; Optimizing Plant Efficiency with Attrition Scrubbers; Mining Engineering magazine; Society for Mining, Metallurgy, and Exploration, Inc.; Oct. 2013; pp. 18-19; Englewood, Colorado.

MIP Process Corporation; Attrition Scrubbers; brochure; pp. 1-4; admitted prior art; Sacramento, California.

Jim Sadowski; Processing for Proppants; Physical Separation Technology External Newsletter, Issue 1; Outotec Inc.; Jul. 2008; pp. 1-8; Jacksonville, Florida.

Pacific Minerals Processing; Turbine Attrition Scrubbers; brochure; admitted prior art; pp. 1-2; Perth, Australia.

Philadelphia Mixing Solutions, Ltd.; The Raven 3800 Series Mixer Drive; brochure; 2010; pp. 1-2; Palmyra, Pennsylvania.

Linatex Limited; Modular Attrition Cells; brochure; 2011; pp. 1-2; Gallatin, Tennessee.

* cited by examiner

AGGREGATE ATTRITION SYSTEMS, METHODS, AND APPARATUS

BACKGROUND

Attrition systems used in some aggregate processing operations generally induce particle-on-particle forces in order to reduce levels of contamination, staining, or turbidity and/or to enhance appearance as may be desired to meet product specifications. The term "attrition" is used in the art to describe, for example, friction or abrasion between particles and/or between particles and a foreign object, e.g., for liberation and/or removal of contaminants, or cleaning, of particles. For example, attrition mills (also known as attrition scrubbers) are sometimes used to remove contaminants such as clays and other undesired materials or staining from aggregate products such as sand (e.g., silica particles, industrial sands, glass sands, or proppants such as frac sand). Attrition processes may also result in rounding of sharp edges of particles to increase sphericity.

DESCRIPTION

Figure 17:
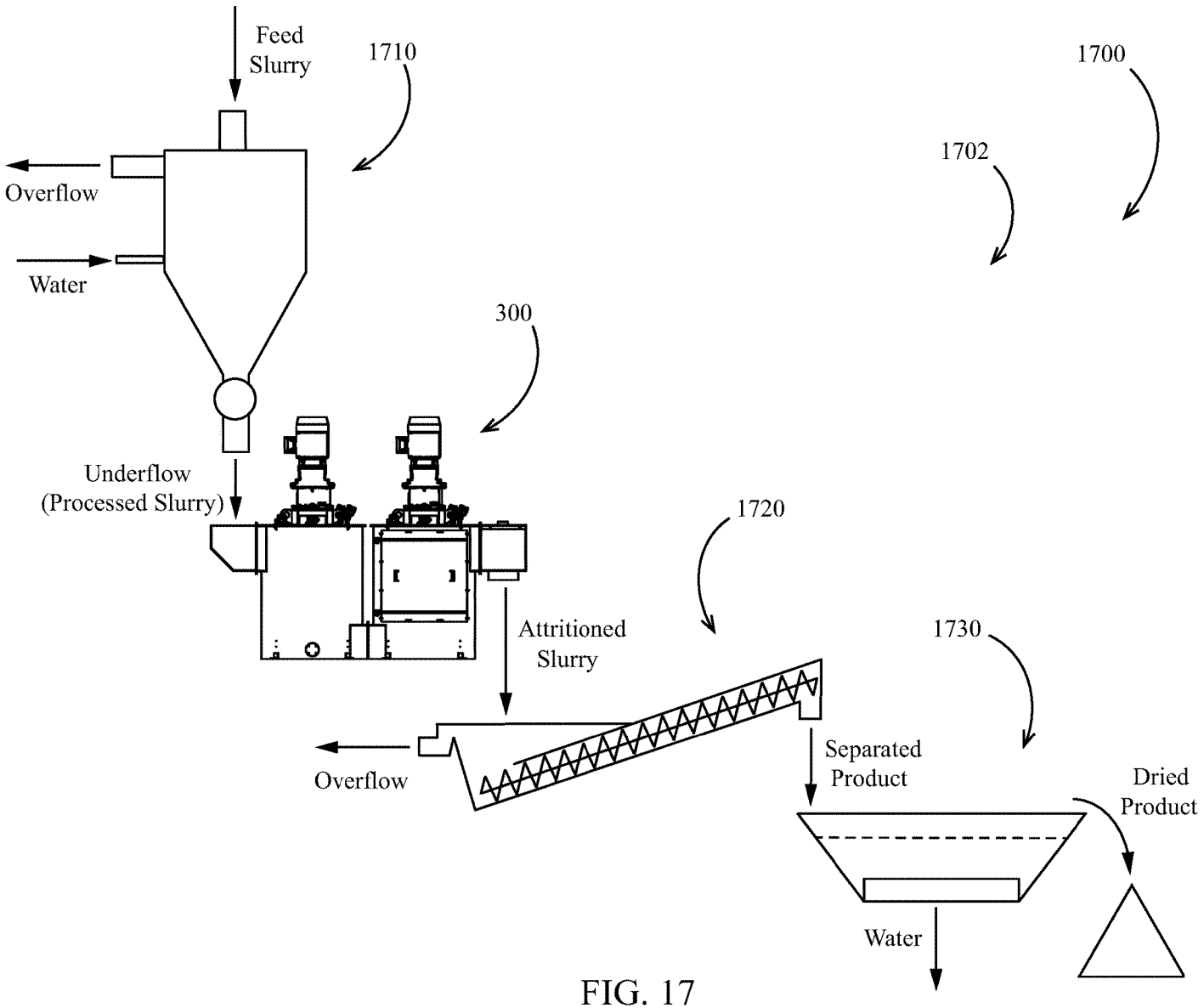
FIG. 17 schematically illustrates an embodiment of an aggregate plant and an embodiment of an aggregate processing flow implementing an attrition mill.

Referring to the drawings, wherein like reference numerals designate identical or corresponding parts throughout the several views, FIG. 17 schematically illustrates an attrition mill 300 optionally employed in an exemplary aggregate processing plant 1700 and a process flow 1702. It should be appreciated that the various attrition mill embodiments described herein may be employed in other plant contexts with different processing steps preceding and following the attrition mill, and may also be used in self-standing implementations or other contexts separate from aggregate processing plants; the plant and process flow described herein are merely illustrative examples.

The plant 1700 and process flow 1702 optionally process a feed slurry (e.g., a solution containing particles such as sand having one or more contaminants thereon such as clay) into a dried, cleaned (e.g., attritioned) and separated product such as sand. Prior to being introduced into the attrition mill 300, the feed slurry is optionally processed to generate a slurry having an appropriate particle size and water content for processing by the attrition mill. The appropriate particle size of the feed slurry may be determined according to the desired specification of the final product. The appropriate water content of the feed slurry is optionally between 20% and 35% by volume. In the illustrated embodiment, the feed slurry is processed prior to the attrition mill 300 by a hydraulic classifier 1710 which optionally includes a feed slurry inlet, a water inlet, an overflow outlet (for discharge of smaller particles and fines) and an underflow outlet (for discharge of the processed slurry into the attrition mill). The hydraulic classifier 1710 may comprise one of the embodiments disclosed in U.S. Pat. No. 4,533,464, incorporated by reference herein in its entirety. In other embodiments, the feed slurry may be processed prior to the attrition mill 300 by another apparatus suitable for classifying and adjusting the water content of the feed slurry.

After processing by the hydraulic classifier 1710 or other apparatus, processed slurry is optionally transferred (e.g., by gravity or by pumping) to the attrition mill for attritioning (e.g., cleaning, liberating of contaminants from the particles) as described further herein. After processing by the attrition mill, the attritioned slurry is optionally transferred (e.g., by gravity and/or by pumping) for further processing to separate the contaminants from the attritioned slurry. In the illustrated embodiment, this step is carried out by a dewatering screw 1720 having an overflow from which the liberated contaminants are optionally carried by a first portion of the slurry, while the second portion of the slurry lifted by the sand screw to an upper outlet optionally comprises the separated product (e.g., a slurry comprising the cleaned particles and water). In other embodiments, a density separator may be used in additionally or alternatively to a sand screw to separate the contaminants from the attritioned slurry.

The separated product is optionally transferred (e.g., by gravity and/or by pumping) to a dewatering apparatus such as a dewatering screen 1730. The remaining water in the separated product (and in some implementations any remaining fines still in the slurry) is optionally removed and discarded by the dewatering screen 1730. The dewatering screen 1730 optionally discharges dried product which is optionally transferred (e.g., by conveying and/or by gravity) to storage. The dewatering screen and the sand screw described herein may comprise the embodiments disclosed in U.S. Pat. No. 8,695,804, incorporated by reference herein in its entirety.

Referring to FIGS. 1-5, the attrition mill 300 is illustrated having two attrition cells 100, 200 arranged in series. Material (e.g., the processed slurry described above) to be processed is optionally transferred to the first attrition cell 100 for processing, then optionally transferred to the second attrition cell 200 for processing, and then optionally discharged from the second attrition cell as described further herein. The first and second attrition cells 200 optionally include generally similar structure except as otherwise described herein.

The first attrition cell 100 optionally includes an inlet hopper 110 for receiving material to be processed by the attrition mill 300. The inlet hopper 110 optionally includes a hopper inlet 112 at an upper end thereof for receiving material. The inlet hopper 110 optionally includes an angled surface 114 disposed to guide material toward an inlet portal 116 through which material optionally enters a tank 120.

The tank 120 is optionally generally cylindrical, and internal sidewalls 121 of the tank are optionally generally cylindrical; in alternative embodiments the interior of the tank may have a square, rectangular, or other horizontal cross-section. The tank 120 may be made of metal; the internal surfaces of the tank are optionally provided with a liner made of a suitable material such as urethane, rubber or another resin-based material. The liner may be removable and/or replaceable and may have a thickness such as a half-inch or one inch. It should be appreciated that dimensions referencing the inner surfaces of the tank herein refer to the dimensions when such a liner is installed unless otherwise indicated. The tank 120 optionally at least partially receives a propeller shaft assembly 400-1 which is optionally configured to impose forces on the material received in the tank. It should be appreciated that apparatus referred to herein as "propeller" may also be referred to as an impeller, turbine, blade, etc. according to varying terminology in the art and/or various embodiments. The propeller shaft assembly 400 is optionally driven rotationally driven about a vertical axis by a motor 600 via a gearbox 650. The motor 600 and gearbox 650 are mounted to an upper end of the tank 120 in the illustrated embodiment but may alternatively be mounted to a side of the tank or to separate structure and operably connected to the propeller shaft assembly 400 by intervening gears and/or belts. In embodiments including a first attrition cell 100 and a second attrition cell 200, the first attrition cell may include a motor 600-1 and the second attrition cell may include a motor 600-2; in alternative embodiments, a common motor may be used to power two or more attrition cells. In embodiments comprising multiple motors, the motor 600-1 may drive a gearbox 650-1 and the motor 600-2 may drive a gearbox 650-2.

The propeller shaft assembly 400 optionally includes a plurality of propellers 500 which are optionally configured to propel material vertically. In the illustrated embodiment, the propeller shaft assembly 400 comprises an upper propeller 500*i* disposed at a first height (e.g., optionally at or below a midpoint height of the interior volume of tank 120) and a lower propeller 500*ii* disposed at a second height below the first propeller (e.g., optionally near the interior bottom surface 124 of the tank 120). The upper propeller 500*i* is optionally configured to propel material downward. The lower propeller 500*ii* is optionally configured to propel material upward. In some embodiments, more than two propellers may be used, optionally in opposing pairs configured similarly to the propellers 500*i*, 500*ii* and disposed along the length of the shaft.

The cell 100 optionally includes baffle assemblies 150 comprising baffles 152 which optionally extend substantially along an internal height of the tank 120 (e.g., from at or near the bottom surface 124 to an upper lid 122 of the tank) and are optionally disposed at or near the interior sidewall 121 (e.g., extending from a radially outer end at or adjacent to the interior sidewall 121 of the tank). In some embodiments, the baffles 152 affect the flow profile of material moving through the attrition mill. The baffles 152 are optionally substantially planar. In the illustrated embodiment, a plurality of baffle assemblies 150*a*, 150*b*, 150*c*, 150*d* are disposed in radially spaced relation along the sidewall 121 and in some embodiments are disposed radially symmetrically about the rotational axis of the propeller shaft assembly 400. A portal 350 optionally comprises an outlet 130 of the tank 120 and/or an inlet 230 of a tank 220 of the attrition cell 200. The outlet 130 is optionally fluidly coupled to the inlet 230. The sizes and/or shapes of outlet 130 and inlet 230 optionally correspond to one another. A flange 138 arranged at least partially around outlet 130 optionally has openings corresponding to openings in a flange 238 arranged at least partially around inlet 230 such that the outlet 130 and inlet 230 may be fluidly coupled by mounting flange 138 to flange 238. The portal 350 is optionally disposed at a height at or near the bottom of the tank 120 and is optionally disposed on an opposing side of the tank from the inlet portal 116.

In operation, material optionally enters the portal 116 of the tank 120 from the inlet hopper 110 and generally moves downward toward the portal 350 due to gravitational forces and/or hydrostatic forces. Before reaching the portal 350, the material is optionally propelled into a repetitive churning motion in a generally annular attrition zone Za disposed generally between the upper and lower propellers 500*i*, 500*ii* by rotation of the propellers. The churning motion, which may comprise spiraling, eddying, and/or swirling motion of particles between the propellers, optionally causes attrition (e.g., abrasion, contact friction) between particles such that contaminants are liberated from the particles. As the particles are propelled by rotation of the propeller shaft assembly 400, the baffles 152 optionally slow the radial movement of particles near the sidewall 121, thus preventing the material from simply rotating (e.g., synchronously, unitarily) with the propeller shaft assembly 400 such that the desired churning motion is achieved. The particles eventually escape the attrition zone and proceed to the portal 350 and into the tank 220 of attrition cell 200.

The tank 220 is optionally generally cylindrical, and internal sidewalls 221 of the tank are optionally generally cylindrical; in alternative embodiments the interior of the tank may have a square, rectangular, or other horizontal cross-section. The tank 220 optionally at least partially receives a propeller shaft assembly 400-2 which is optionally configured to impose forces on the material received in the tank. The propeller shaft assembly 400 is optionally driven rotationally about a vertical axis by a motor 600 via a gearbox 650. The motor 600 and gearbox 650 are mounted to an upper end of the tank 220 in the illustrated embodiment but may alternatively be mounted to a side of the tank or to separate structure and operably connected to the propeller shaft assembly 400 by intervening gears and/or belts. The tanks 120, 220 are optionally mounted to support structure and/or weights by brackets 194, 294 respectively in order to maintain the position of the attrition mill 300 during operation, which may generate unbalanced forces.

The propeller shaft assembly 400 optionally includes a plurality of propellers 500 which are optionally configured to propel material vertically. In the illustrated embodiment, the propeller shaft assembly 400 comprises an upper propeller 500*i* disposed at a first height (e.g., optionally at or below a midpoint height of the interior volume of tank 220) and a lower propeller 500*ii* disposed at a second height below the first propeller (e.g., optionally near the interior bottom surface 124 of the tank 120). The upper propeller 500*i* is optionally configured to propel material downward. The lower propeller 500*ii* is optionally configured to propel material upward. In some embodiments, more than two propellers may be used, optionally in opposing pairs configured similarly to the propellers 500*i*, 500*ii* and disposed along the length of the shaft.

The cell 200 optionally includes baffle assemblies 250 comprising baffles 252 which optionally extend at least partially (e.g., substantially) along an internal height of the tank 220 (e.g., from at or near the bottom surface 224 to an upper lid 222 of the tank) and are optionally disposed at or near the interior sidewall 221 (e.g., extending from a radially outer end at or adjacent to the interior sidewall 221 of the tank). The baffles 252 are optionally substantially planar. Each baffle 252 optionally includes a handle 257 (e.g., at an upper end thereof). Each baffle 252 is optionally mounted to a bracket 256 (which may be supported on lid 222) by an attachment 258. In the illustrated embodiment, a plurality of baffle assemblies 250*a*, 250*b*, 250*c*, 250*d* are disposed in radially spaced relation along the sidewall 221 and in some embodiments are disposed radially symmetrically about the rotational axis of the propeller shaft assembly 400. A portal 212 optionally comprises an outlet of the tank 220 corresponding to an inlet of an outlet hopper 210 of the attrition cell 200. The portal 212 is optionally disposed at a height at or near the top of the tank 120 and is optionally disposed on an opposing side of the tank from the portal 350.

In operation, material optionally enters the tank 220 through the portal 350 from first attrition cell 100 and generally moves upward toward the portal 212 due to gravitational and/or hydrostatic forces. It should be appreciated that in the illustrated embodiment, the forces imposed on the material by the propellers tend to counterbalance one another (e.g., because the upper and lower propellers are optionally of substantially the same dimensions with opposing pitch as illustrated) such that the movement of material from the inlet hopper 110 to the outlet hopper 210 is generally caused by hydrostatic forces, particularly where the material is received by inlet hopper 110 from a position (e.g., the outlet of a hydrosizer as described herein) at or above the outlet hopper 210. The inlet (e.g., hopper inlet) of the attrition mill is optionally disposed vertically higher than the outlet (e.g., hopper outlet) such that hydrostatic forces move the slurry through the attrition mill from the inlet to the outlet (e.g., as the slurry seeks to find its level). In some alternative embodiments, propellers or a pressure source may additionally or alternatively urge the slurry through the attrition mill. Before reaching the portal 212, the material is optionally propelled into a repetitive churning motion in a generally annular attrition zone Za disposed generally between the upper and lower propellers 500*i*, 500*ii* by rotation of the propellers. The churning motion, which may comprise spiraling, eddying, and/or swirling motion of particles between the propellers, optionally causes attrition (e.g., abrasion, contact friction) between particles such that contaminants are liberated from the particles. As the particles are propelled by rotation of the propeller shaft assembly 400, the baffles 252 optionally slow the radial movement of particles near the sidewall 221, thus preventing the material from simply rotating (e.g., synchronously, unitarily) with the propeller shaft assembly 400 such that the desired churning motion is achieved. The particles eventually escape the attrition zone and proceed to the portal 212.

The material exiting portal 212 optionally passes through an outlet hopper 210. In some embodiments, the material falls by gravity from the outlet hopper 210 through a hopper outlet 214 for further processing as described herein.

In some modes including an installation (e.g., plant building or modification) mode, the attrition mill 300 is optionally modularly operably connectable to any one of a plurality of inlets to receive materials from the selected inlet, where the operable connection is optionally lossless or substantially lossless. In some embodiments, the modular connection is made to a flange 128 of the cell 100. The flange 128 is optionally arranged around the portal 116 of the tank 120. The flange 128 optionally corresponds to (e.g., has a corresponding size, shape and/or corresponding openings for the use of fasteners such as bolts) a flange 118 which is provided on the inlet hopper 110. Fasteners in the flange 118 and flange 128 are optionally arranged about the portal 116 (e.g., in equally radially spaced relation). The inlet hopper 110 may be modularly replaced with one or more alternative inlets (e.g., a pipe or chute) placing the cell 100 in fluid connection with an upstream apparatus (such as a hydrosizer or density separator), each of which alternative inputs optionally has a flange 118 arranged around an outlet thereof and corresponding to the flange 218. It should be appreciated that the modular connection to alternative inlets may be achieved by other corresponding structures on the inlets and the cell 100 such as threading or other mating structure. In some embodiments, a seal (e.g., annular seal) may be introduced between the flanges 118 and/or 128 (or other structure) to reduce or eliminate loss of material between the inlet and the cell 100, or the opposing faces (e.g., planar or mating faces) of the flanges may be sufficiently compressed together by fasteners to reduce or eliminate loss of material between the inlet and the cell 100.

In some modes including an installation (e.g., plant building or modification) mode, the attrition mill 300 is optionally modularly operably connectable to any one of a plurality of outlets to transfer materials to the selected outlet, where the operable connection is optionally lossless or substantially lossless. In some embodiments, the modular connection is made to a flange 228 of the cell 200. The flange 228 is optionally arranged around the portal 212 of the tank 220. The flange 228 optionally corresponds to (e.g., has a corresponding size, shape and/or corresponding openings for the use of fasteners such as bolts) a flange 218 which is provided on the outlet hopper 210. Fasteners in the flange 218 and flange 228 are optionally arranged about the portal 212 (e.g., in equally radially spaced relation). The outlet hopper 210 may be modularly replaced with one or more alternative inlets (e.g., a pipe or chute) of a downstream apparatus, placing the cell 200 in fluid connection with the downstream apparatus (such as a sand screw or density separator), each of which alternative inputs optionally has a flange 218 arranged around an outlet thereof and corresponding to the flange 218. It should be appreciated that the modular connection to alternative inlets may be achieved by other corresponding structures on the inlets and the cell 100 such as threading or other mating structure. In some embodiments, a seal (e.g., annular seal) may be introduced between the flanges 218 or 228 (or other structure) to reduce or eliminate loss of material between the inlet and the cell 200, or the opposing faces (e.g., planar or mating faces) of the flanges may be sufficiently compressed together by fasteners to reduce or eliminate loss of material between the cell 200 and the outlet.

In some modes including an installation (e.g., plant building or modification) mode, any number of additional attrition cells may optionally be modularly operably connected to one another to form an attrition mill having any number of attrition cells. The attrition mill is thus optionally modularly expandable. For example, to form a four-cell embodiment, two attrition mills 300 similar to the embodiment illustrated in FIGS. 1-5 may be placed in series by removing (or not installing) the outlet hopper 210 of the first attrition mill, removing (or not installing) the inlet hopper 110 of the second attrition mill, and joining the flange 228 to the flange 128. The flange 128 thus optionally corresponds to (e.g., has a corresponding size, shape and/or corresponding openings for the use of fasteners such as bolts) the flange 228 in order to enable modular expandability of the attrition mill 300. It should be appreciated that the modular connection to additional attrition cells 100, 200 or attrition mills 300 may be achieved by other structure (such as threading or other mating structure) and may be sealed with an annular seal or other sealing apparatus as described above such that the modular connection between attrition cells and/or attrition mills is optionally lossless or substantially lossless.

Figure 18:
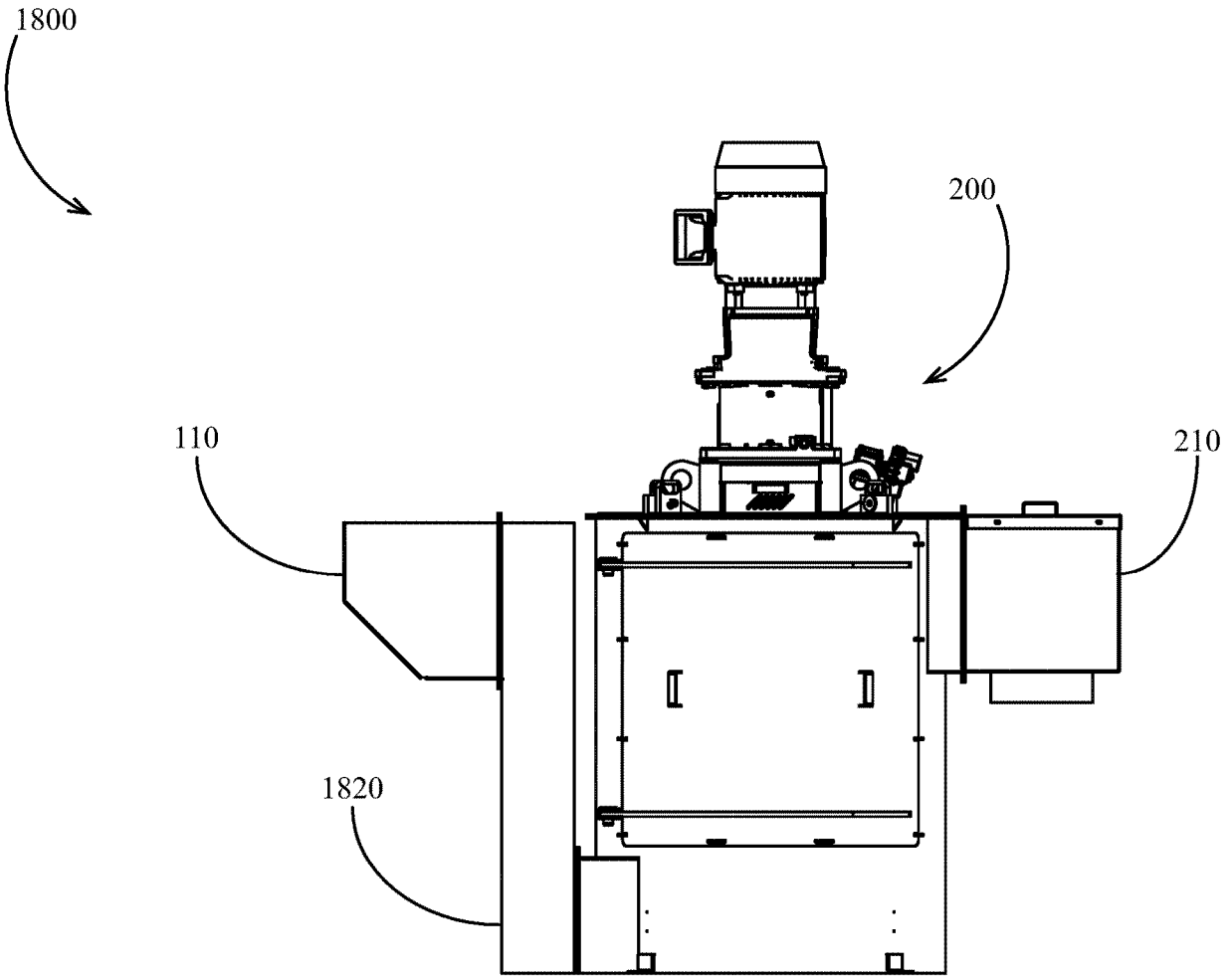
FIG. 18 is a side elevation view of an embodiment of an attrition mill comprising a single attrition cell.

An attrition mill 1800 having a single attrition cell 200 is illustrated in FIG. 18. A riser section 1820 optionally joins an inlet hopper 110 to the attrition cell 200 (e.g., by use of flanged connections) and places the inlet hopper 110 in fluid communication with the attrition cell 200. The riser section 1820 optionally comprises a generally hollow structure having an inlet and an outlet, which inlet and outlet optionally comprise flanges for connection to the inlet hopper 110 and the cell 200, respectively. The riser section 1820 optionally supports the inlet hopper 110 at a height at or above the outlet hopper 210 of the cell 200. One or more additional attrition mills 300 may be modularly connected in series to the attrition mill 1800 in order to build attrition mills having an odd number of attrition cells.

Figure 6:
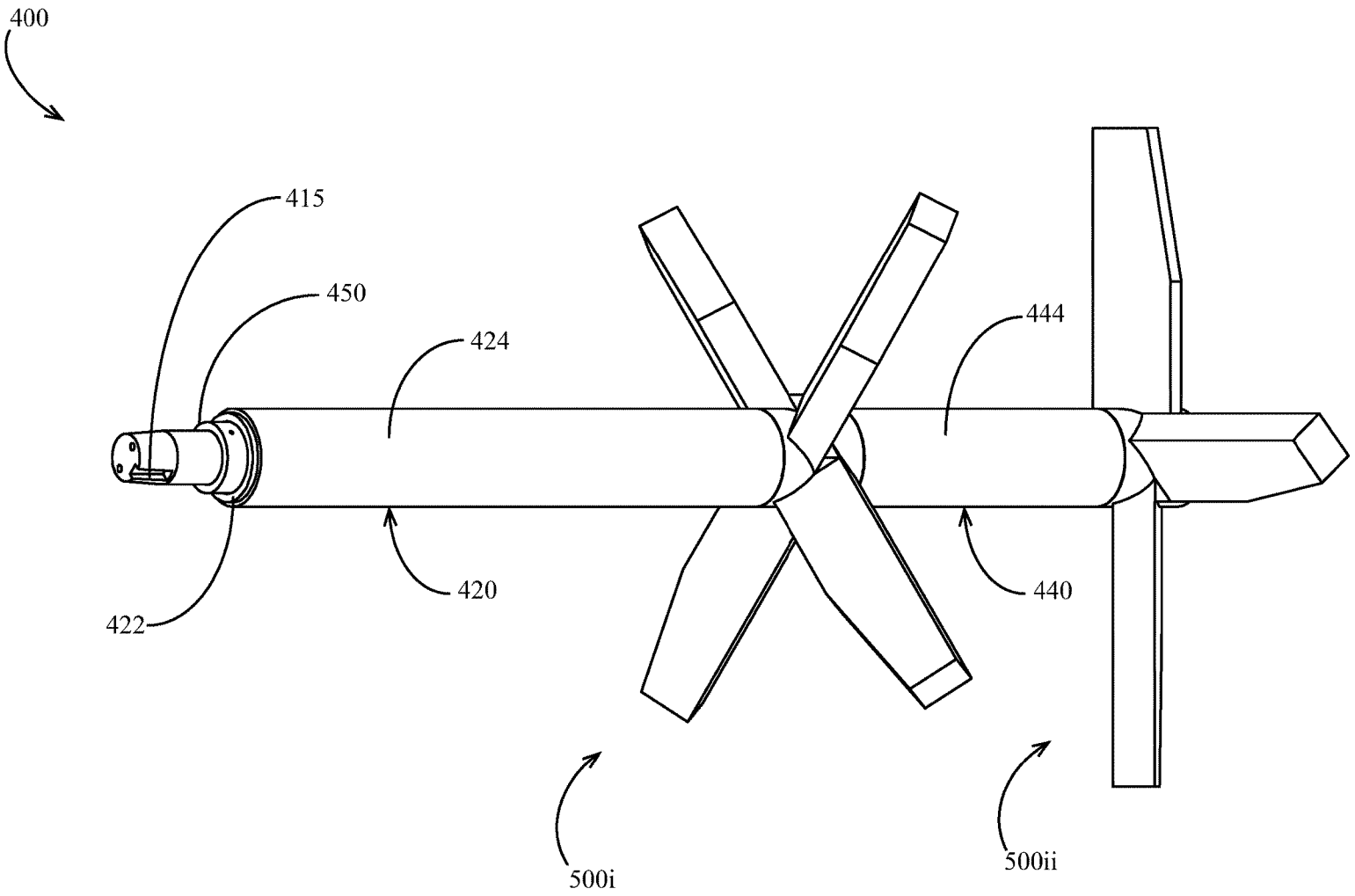
FIG. 6 is a perspective view of an embodiment of a propeller shaft assembly.
Figure 7:
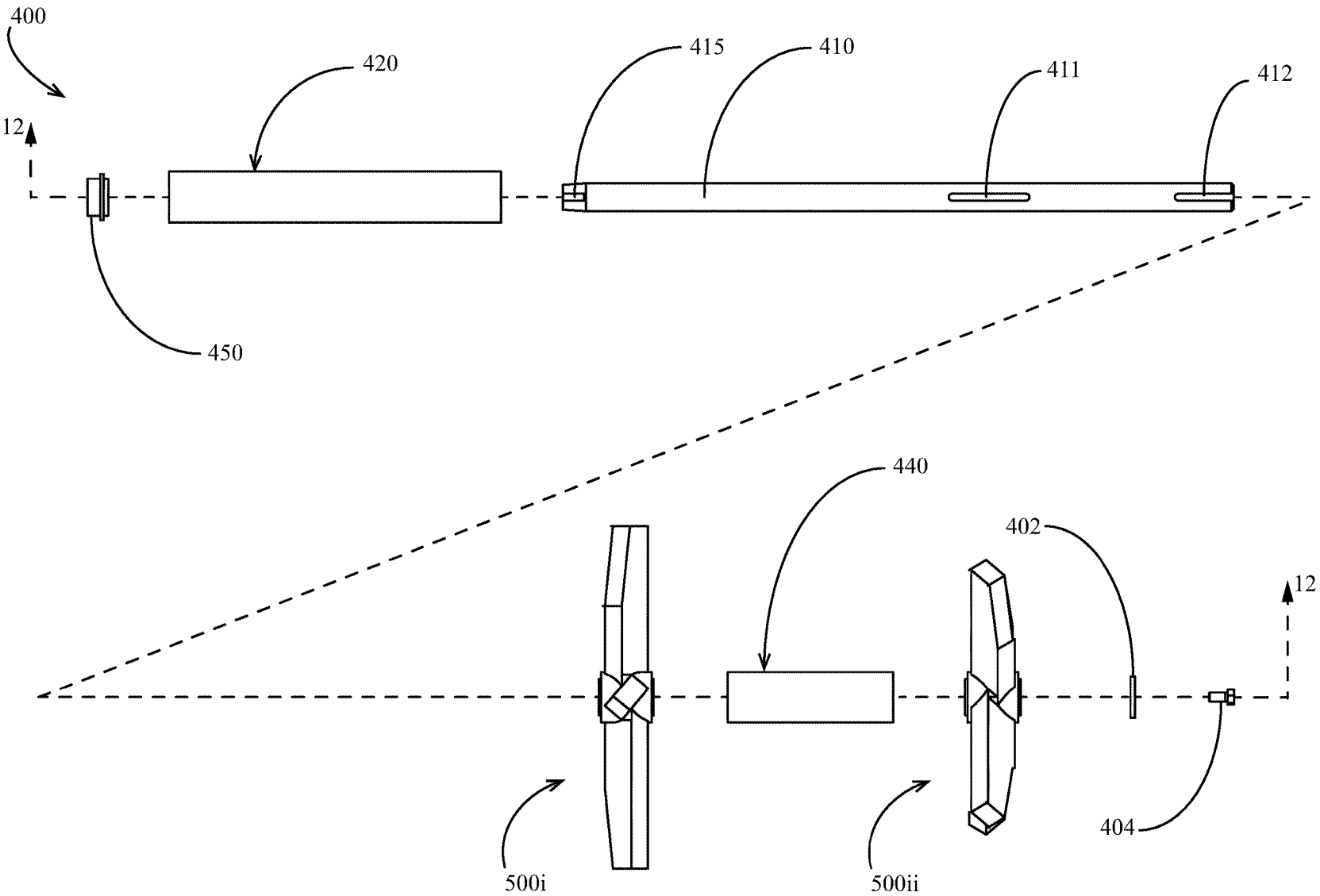
FIG. 7 is an exploded view of the propeller shaft assembly of FIG. 6.
Figure 12:
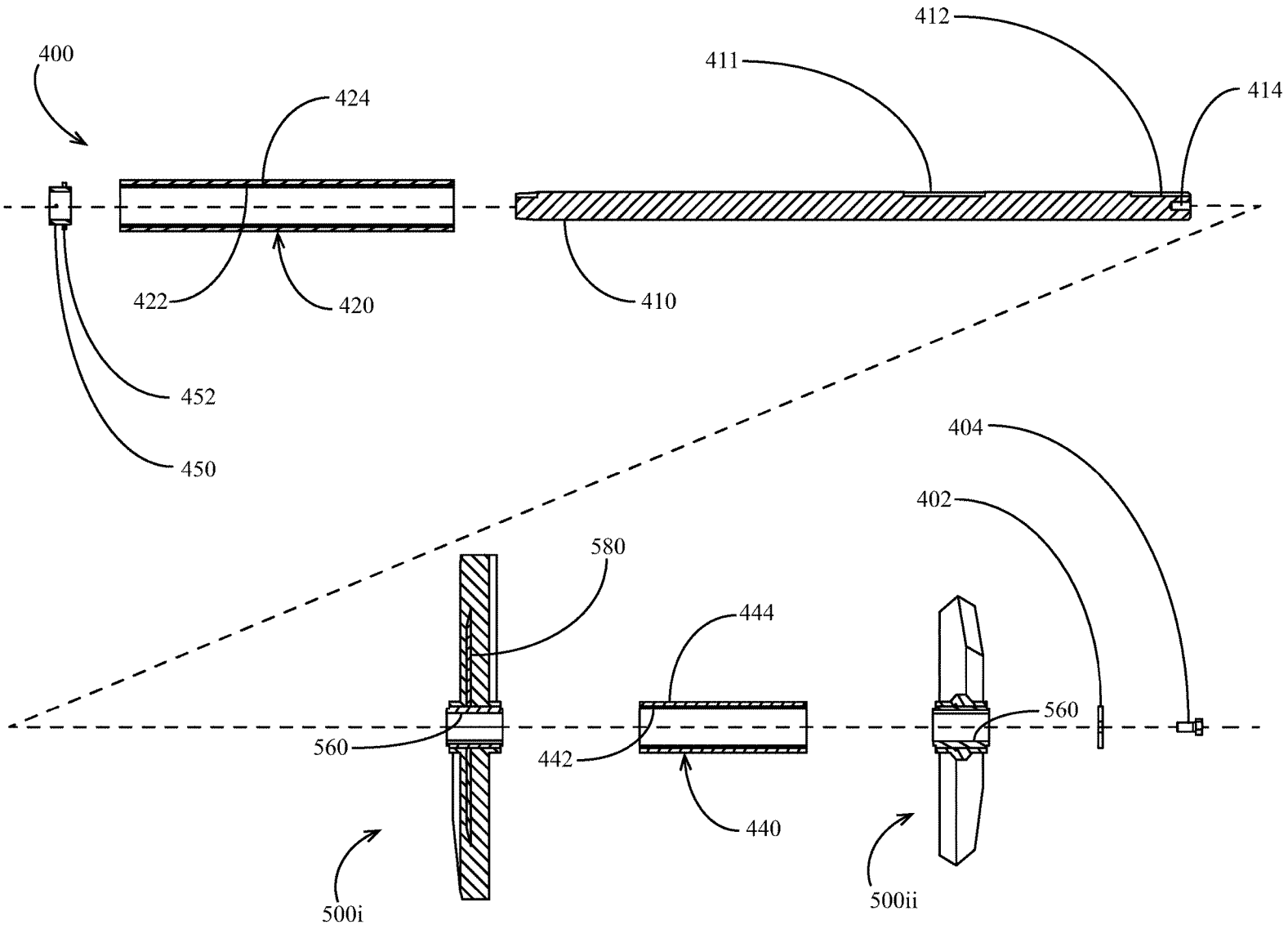
FIG. 12 is an exploded sectional view of the propeller shaft assembly of FIG. 6 along the section 12-12 of FIG. 7.

Referring to FIGS. 6, 7 and 12, a propeller shaft assembly 400 optionally incorporated in each of the attrition cells 100, 200 is illustrated in more detail. The propeller shaft assembly 400 optionally generally comprises a shaft 410 supporting an upper propeller 500*i* and a lower propeller 500*ii*. In the illustrated embodiment, the propellers 500*i*, 500*ii* are of substantially the same construction but are disposed in reverse orientations and are optionally offset from one another by 45 degrees about the rotational direction of the shaft 410. In alternative embodiments, rather than comprising a unitary shaft, the shaft 410 may comprise a plurality of separable shaft portions (which may be, for example, coupled to one another and/or or to the propellers by threading disposed at one or more ends thereof).

An upper portion 415 of the shaft 410 is optionally configured to be driven for rotation by the gearbox 650 (e.g., by a notch or other feature engaged by corresponding structure in the gearbox). The gearbox 650 may also support the weight of the propeller shaft assembly 400.

A fastener such as a bolt 404 and corresponding washer 402 are optionally removably mounted to a bottom end of the shaft 410, e.g., by threading into a threaded cavity 414 provided in the bottom end of the shaft. The bolt 404 optionally operably supports the propeller 500*ii*. The bolt 404 optionally retains the vertical (e.g., axial) position of propeller 500*ii* relative to the shaft 410. A lower spacer 440 optionally supports and/or retains the vertical (e.g., axial) position of the upper propeller 500*i* in vertical spaced apart relation above the lower propeller 500*ii*. The lower spacer 440 optionally removably covers a portion of the shaft 410 below the upper propeller 500*i*. It should be appreciated that a height of the lower spacer 440 may at least partially determine a height of the attrition zone Za described herein. The upper propeller 500*i* optionally rests axially on the lower spacer 440. An upper spacer 420 optionally rests axially on the upper propeller 500*i*. The upper spacer 420 optionally removably covers a portion of the shaft 410 above the upper propeller 500*i*.

Figure 14:
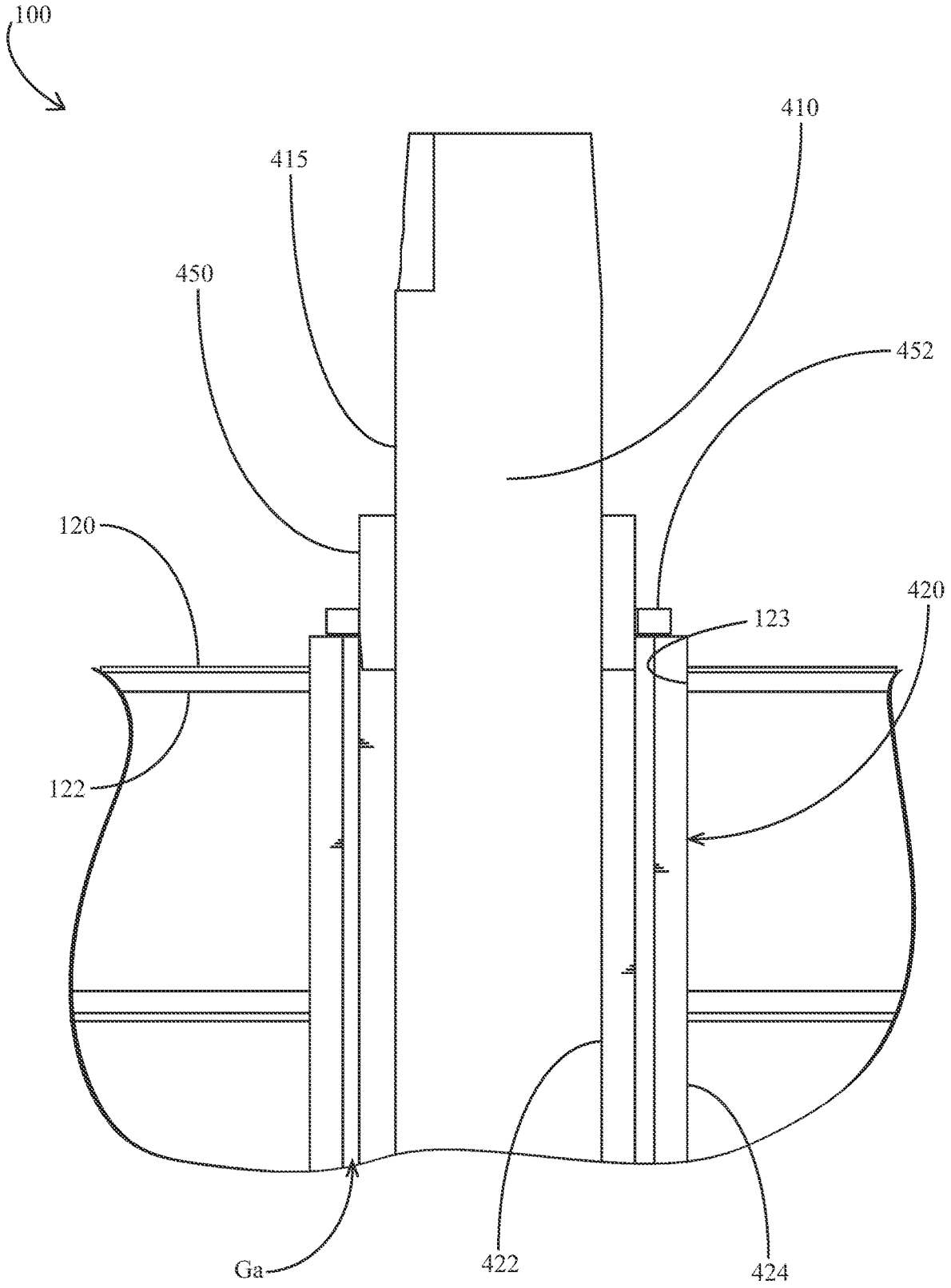
FIG. 14 is an expanded view of a portion of the view of FIG. 13.

Referring to FIG. 14, the upper spacer 420 optionally extends through an opening 123 (e.g., circular opening) in the upper lid 122 of the tank 120. The upper spacer 420 optionally rotates freely relative to the upper lid 122 but optionally substantially fills (e.g., substantially seals) the opening 123 in the lid 122. In some embodiments, a seal arranged around the shaft at or near the top of the tank 120 may additionally or alternatively prevent materials from exiting or entering lid 122 around the assembly 400. Continuing to refer to FIG. 14, a bushing 450 is optionally mounted to the upper portion 415 of the shaft 410. The bushing is optionally partially received in an annular gap Ga between the upper spacer 420 and the shaft 410. The bushing is optionally rigidly mounted to the shaft 410 and optionally removably mounted to the shaft 410 such as by one or more set screws or other selectively attached fasteners. An annular washer 452 is optionally mounted (e.g., by welding) to the bushing 450. The washer 452 optionally abuts to an upper end of the upper spacer 420; in operation, an upward force imposed by processed material on the propellers 500 is optionally transferred by the spacer 420 to the washer 452. The washer 452 and bushing 450 thus optionally cooperate to retain the propellers 500 in their vertical position relative to shaft 410 when upward forces are imposed on the propellers.

The lower spacer 440 optionally comprises a shell 442 (e.g., a cylinder or tube which may be made of steel or other metal, or made of plastic, urethane, or other material) having an outer lining 444 (e.g., made of rubber, urethane or other material). The upper spacer 420 optionally comprises a shell 422 (e.g., a cylinder or tube made of steel or other metal, or made of plastic, urethane, or other material) having an outer lining 424 (e.g., made of rubber, urethane or other material). The outer lining of the spacers described herein may also be described as lagging. An annular gap (e.g., the gap Ga illustrated in FIG. 14) is optionally defined between the shaft 410 and the inner surface of each spacer 420, 440. In alternative embodiments, the lining 444 and/or the lining 424 may be omitted.

In alternative embodiments, the assembly 400 may comprise spacers 420, 440 which separably join the propellers 500*i*, 500*ii* to one another; in such embodiments, the shaft may be separable and/or omitted. Alternatively or additionally, the spacers 420, 440 may also join the shaft 410 to one or both of the propellers 500*i*, 500*ii*. In some alternative embodiments, each of the spacers 420, 440 may comprise a solid tube (e.g., a metal tube such as steel having urethane or rubber lagging, or a solid urethane tube); in some such embodiments, the shaft may be separable or omitted. In some alternative embodiments, the spacers, propellers and/or shaft may be separably joined by mating threaded portions (e.g., threaded extrusions and threaded openings) or other suitable structure. In such alternative embodiments in which some components of the assembly 400 are threaded together, the threading on each joint is optionally oriented such that the force of the slurry on the propellers tends to tighten rather than loosen the threaded joints.

It should be appreciated that although various components (e.g., shaft, spacers, shells, linings, etc.) are described herein as having generally cylindrical horizontal cross-sections according to some embodiments, in alternative embodiments any or all such components have different horizontal cross-sections (e.g., oval, elliptical, square, rectangular, triangular, pentagonal, hexagonal, etc.).

Turning to FIGS. 5, 8-10 and 12, the propeller 500 is illustrated in more detail. As described herein, the propellers 500*i* and 500*ii* are optionally substantially similar other than their optionally vertically flipped and 45 degree offset orientation when installed, although in other embodiments the propellers may additionally differ from one another in design and/or construction. Each propeller 500 optionally includes a plurality of propeller blades 540; in the illustrated embedment, the propeller 500 comprises four propeller blades 540*a*, 540*b*, 540*c*, 540*d* extending outwardly from a central axis of the propeller 500 and optionally radially spaced about the central axis (e.g., at equal intervals such as 90 degrees) of the propeller 500.

Figure 10:
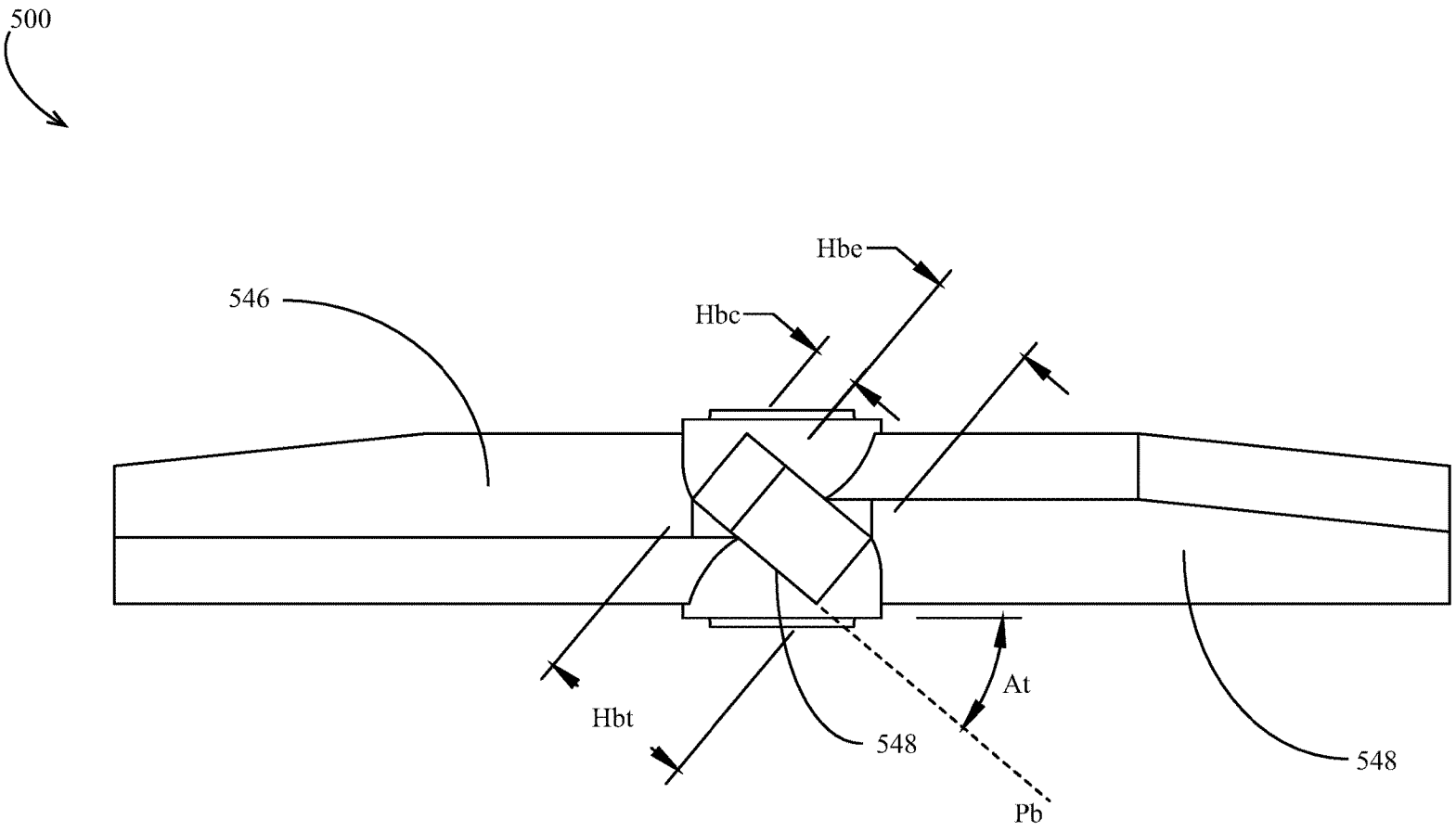
FIG. 10 is a side elevation view of the propeller of FIG. 8.

Referring to FIG. 10, each blade 540 is optionally disposed (e.g., canted, sloped, angled, etc.) at an angle At relative to horizontal and is optionally disposed to impose a vertical force and shear force on the material (e.g., sand slurry) in the tank 120. Each blade is optionally canted forward; in alternative embodiments, one or more blades is not canted forward and may be canted rearward or disposed generally horizontally or vertically. The angle At is optionally selected such that the vertical force on the material is greater (e.g., slightly greater) than the shear force. The angle At may be defined as the angle of a surface disposed to engage (e.g., push against) the material in operation; for example, where the propeller illustrated in FIG. 10 is employed as upper propeller 500*i*, the angle At may be measured between horizontal and a plane Pb defined by material-engaging surface 548 of the blade 540. The angle At may be alternatively defined as the angle of a plane generally defined by the blade instead of a surface thereof. In various embodiments, the angle At maybe 45 degrees or less and is optionally 40 degrees or approximately 40 degrees.

Figure 8:
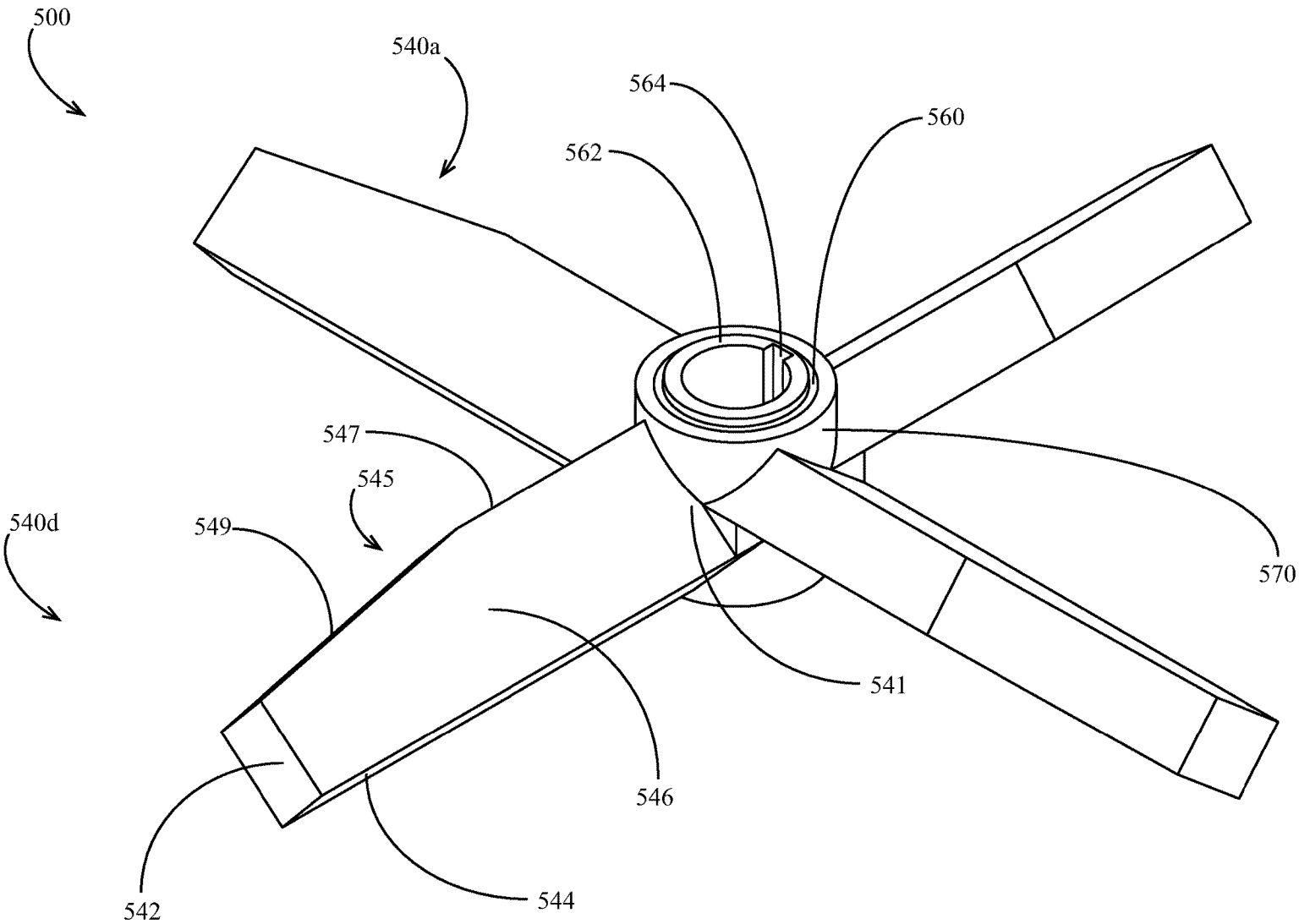
FIG. 8 is a perspective view of an embodiment of a propeller.
Figure 9:
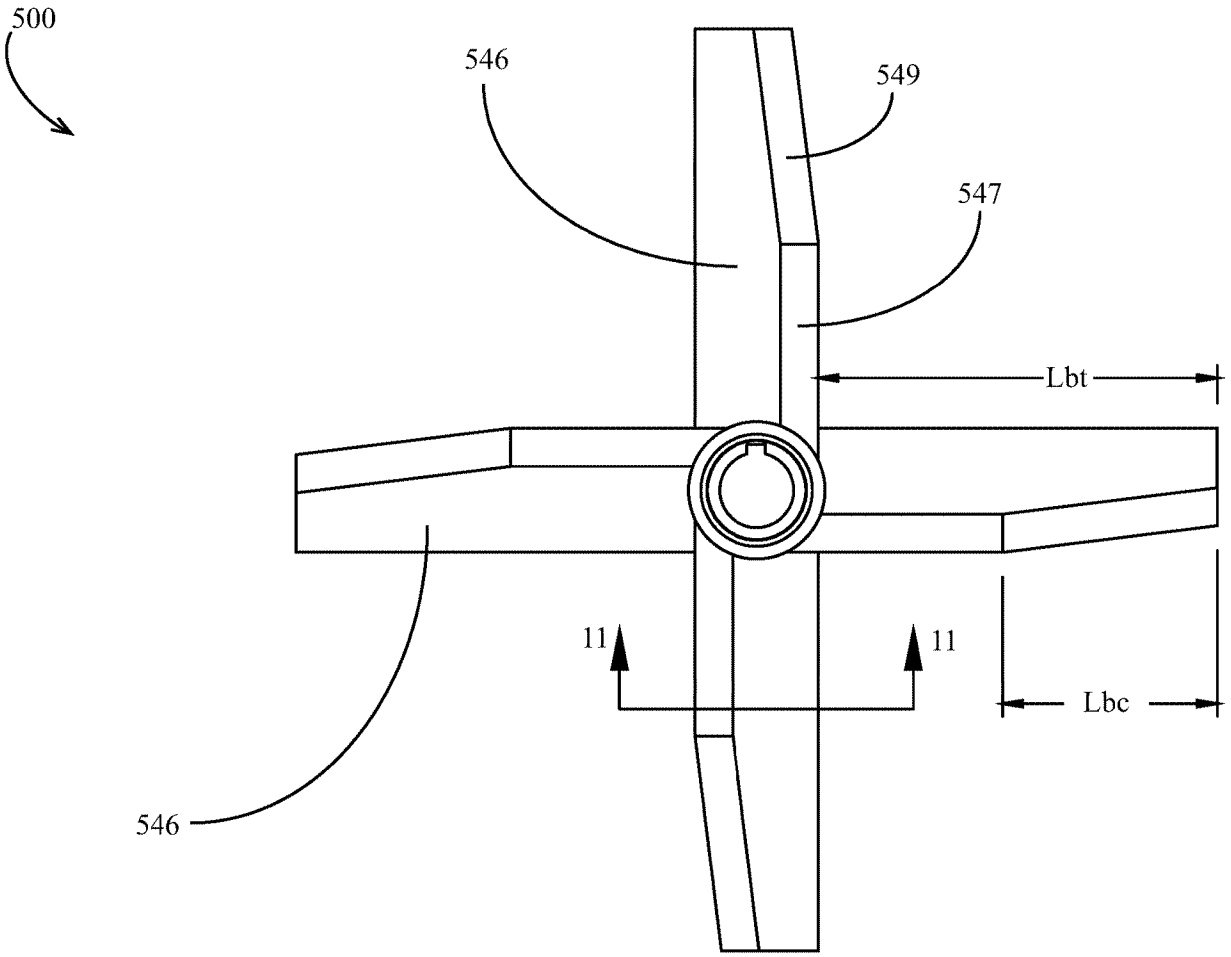
FIG. 9 is a plan view of the propeller of FIG. 8.

Referring to FIGS. 8-10, each blade 540 optionally comprises an inner end 541 (having a height Hbt) disposed adjacent to or forming a part with an axial core 570, an outer end 542 (having a height Hbe), and a lower surface 544 extending between the inner end and the outer end 542. An upper surface 545 optionally extends between the inner end and the outer end 542 on the opposite side of the blade from the lower surface 544. The blade 540 optionally extends a radial length Lbt from the axial core 570 to the outer end 542. In the illustrated embodiment, the upper surface 545 comprises an inner upper surface 547 and an outer upper surface 549. The outer upper surface 549 optionally comprises a chamfered surface. Due to the outer upper surface 549 being chamfered, the height Hbe of outer end 542 is optionally less than (e.g., between ⅔ and ¾ of) the height Hbt of the inner end 541. The surface 549 optionally has a height Hbc. A radial length Lbc (e.g., measured along the same radial direction as the length Lbt) of chamfered upper surface 549 optionally extends about half the length Lbt of the blade 540. Each blade 540 optionally comprises first and second opposing surfaces 546, 548. Depending on the orientation and direction of rotation of the propeller 500, the surfaces 546, 548 may each comprise a forward (material-engaging) surface or a rearward surface. In operation, the propeller 500 optionally turns in the direction of the forward surface so that the forward surface engages the material and imposes vertical and shear forces on the material. For example, if the propeller 500 illustrated in FIG. 10 comprises the upper propeller 500*i*, the second opposing surface 548 is optionally the forward, material-engaging surface and the first opposing surface 546 is optionally the rearward surface; it should be appreciated that in such an example the surface 548 of the blade 540 illustrated to the right in FIG. 10 would move generally out of the page.

It should be appreciated that a momentum imparted to material by the blade 540 may vary with radial distance from the shaft 410 due to increasing blade speed from the inner to the outer ends of the blade. In the illustrated embodiment, the profile of the blade 540 and/or a profile feature thereof (e.g., chamfered upper surface 549) can be selected to reduce the radial variance in momentum, e.g., by having a blade-material contact surface area which decreases with increasing radial distance from the shaft 410.

Referring to FIGS. 8 and 12, the propeller 500 optionally comprises a hub 560 (e.g., a metal hub) which is optionally generally cylindrical and optionally sized and configured to be slidingly received on the shaft 410. As illustrated, the hub 560 is optionally disposed at least partially within the axial core 570 of the propeller 500. Each blade 540 optionally comprises a blade core 580 (e.g., a metal plate or other elongate structure) extending at least partially along the length of the blade. The blade core 580 is optionally mounted (e.g., by welding) to a circumference of the hub 560. In some embodiments, the propeller 500 may be manufactured by welding each blade core 580 to the hub 560 and then using a casting process (e.g., resin casting) to form the remainder of the blades 540 and the axial core 570. The resin used in such process may be any suitable material such as urethane or rubber.

Figure 11:
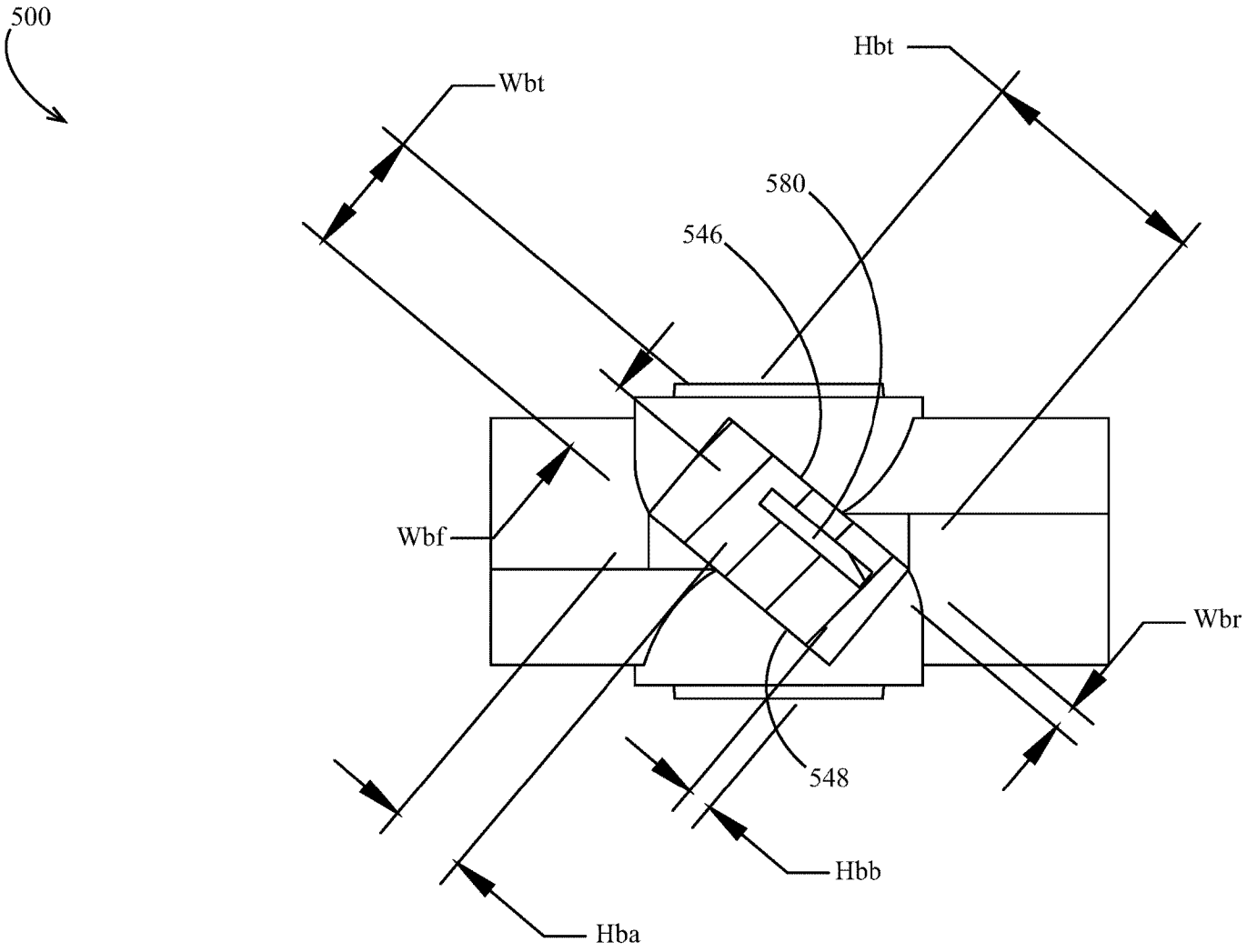
FIG. 11 is a sectional view of the propeller of FIG. 8 along the section 11-11 of FIG. 9.

Referring to FIG. 11, after the casting process is completed, the height Hbt of the blade 540 is optionally greater than the height of the blade core 580 and a width Wbt of the blade 540 is optionally greater than a width of the blade core 580. In some embodiments the blade core may be symmetrically positioned within the remainder of the blade. In the illustrated embodiment, a first cast width Wbf between the blade core 580 and the surface 548 of the blade 540 is greater than a second cast width Wbr between the blade core 580 and the surface 546 of the blade 540. In the illustrated embodiment, a first cast height Hba between the blade core 580 and the upper surface of the blade 540 is greater than a second cast height Hbb between the blade core 580 and the lower surface of the blade 540. In some embodiments, the first cast height Hba is approximately three times the second cast height Hbb and the first cast width Wbf is approximately three times the second cast width Wbr.

Figure 13:
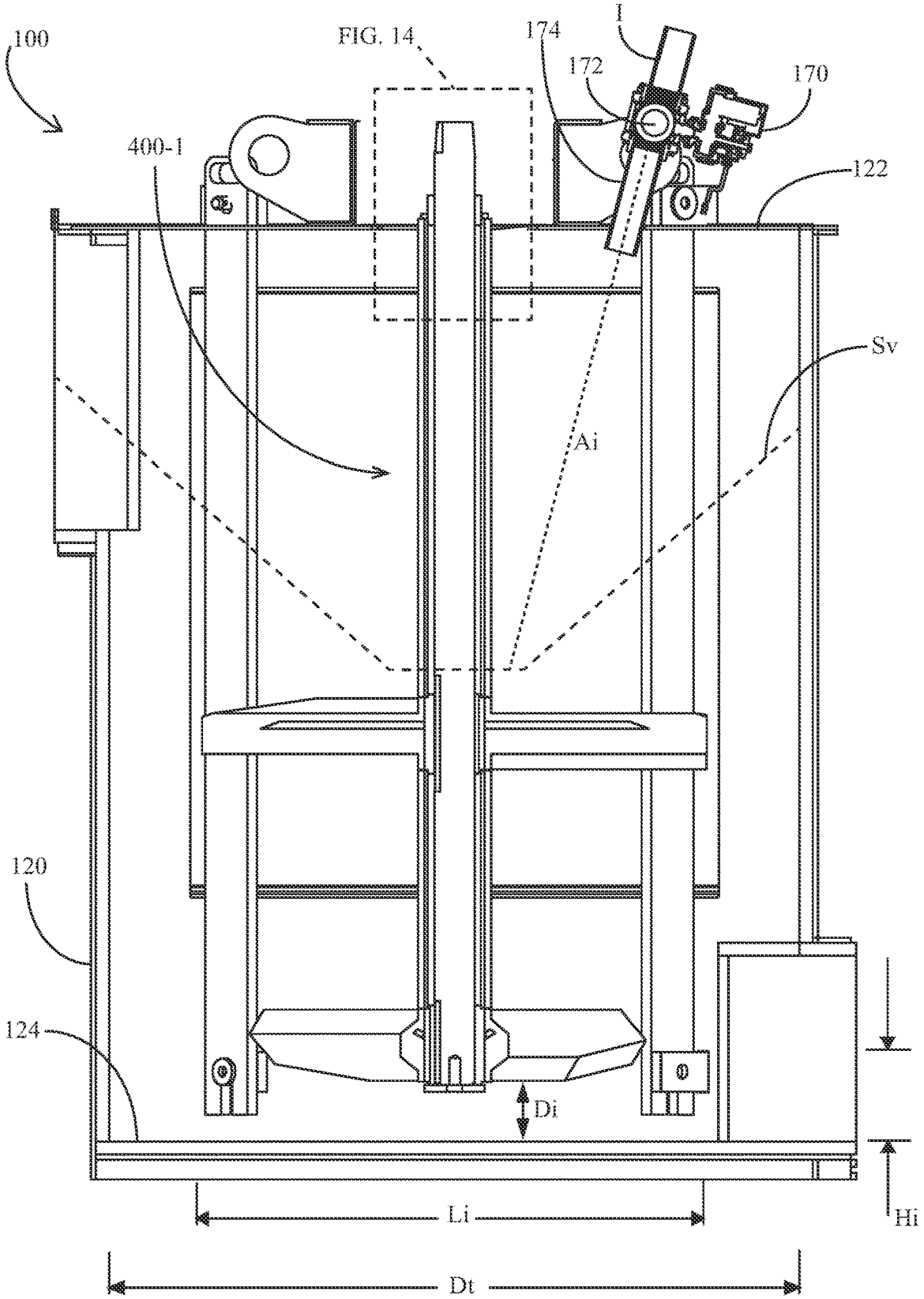
FIG. 13 is a sectional view of an attrition cell of the attrition mill of FIG. 1 along the section 4-4 of FIG. 1, illustrating a fluid level and water injection path within the attrition cell.

In an exemplary embodiment, the blade dimensions referenced herein are as follows: Wbt—2⅜ inches; Wbr—½ inch; Wbf—1½ inches; Hbt—4½ inches; Hba—1½ inches; Hbb—½ inches; Lbt—16 inches; Lbc—8⅝ inches; Hbc—1⅜ inches; Hbe—3⅛ inches. In the exemplary embodiment, the angle At is optionally 40 degrees. Referring to FIG. 13, the inner diameter Dt of tank 120 is optionally 54 inches in the same exemplary embodiment, the height Hi of the propeller (e.g., from the bottom surface of the tank to a central vertical plane of the propeller) is optionally 8¼ inches, and the total length Li of the propeller is optionally 37 inches.

Referring to FIG. 13, a vertical distance Di is defined between the bottom of the lower propeller 500*ii* and the bottom surface 124 of the tank 120, which has a diameter Dt. A ratio Rt between Di and Dt is optionally selected to minimize the amount of material buildup along the bottom circumferential edge of the tank 120 (which may increase with increasing values of Ri) while encouraging effective material attrition (which may be affected by reduced ability of material to flow beneath the propeller 500*ii* for low values of Rt). In some embodiments, the ratio Rt is between 0.1 and 0.2, about 0.15, about 0.153, or 0.153. In an exemplary embodiment, the tank diameter Dt is 54 inches and the vertical distance Di is 8¼ inches.

A ratio Ri of the total length of the propeller Li to the inner diameter Dt of the tank is optionally selected to optimize material attrition and flow, and is optionally about two-thirds (e.g., 0.685 or between 0.65 and 0.7) for sand processing implementation. The ratio Ri may be different for other materials, for example between one-third and two-thirds, about one half, 0.4 or about 0.4.

Figure 19:
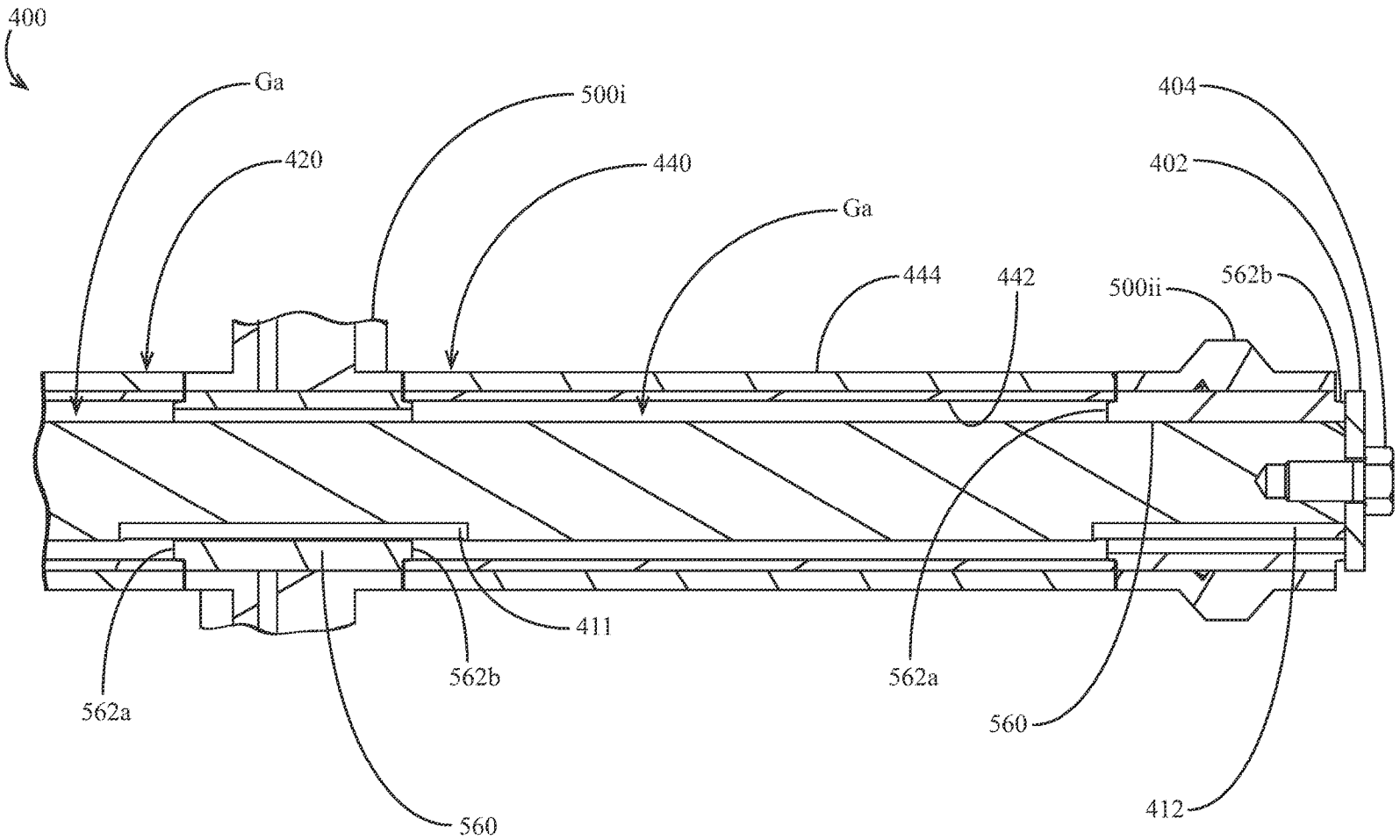
FIG. 19 is a partial sectional view of the propeller shaft assembly of FIG. 6 along the section 12-12 of FIG. 7.

Referring to FIGS. 8 and 19, the hub 560 optionally comprises first and second inner annular rims 562*a*, 562*b* extending in opposing axial directions from the remainder of the hub. When the propeller shaft assembly 400 is assembled, one or more of the annular rims 562 optionally extend into the annular gaps Ga between the spacers 420, 440 and the shaft 410. The annular rims 562 optionally have a radial thickness approximately equal to a radial thickness of the gap Ga. The outer linings 424, 444 optionally axially abut the axial core 570 of the upper propeller 500*i*. The outer lining 444 optionally axially abuts the axial core 570 of the lower propeller 500*ii*. The hub 560 of the upper propeller 500*i* optionally axially abuts the shell 422 of the upper spacer 420. The hub 560 of the upper propeller 500*i* optionally axially abuts the shell 442 of the lower spacer 440. The hub 560 of the lower propeller 500*ii* optionally axially abuts the shell 442 of the lower spacer 440. The hub 560 of the lower propeller 500*ii* optionally axially abuts the washer 402, which is optionally held in place by the bolt 404.

It should be appreciated with reference to FIG. 19 that the outer lining 444 of the lower spacer 440 optionally cooperates with the axial cores of the propellers 500 to substantially seal the shaft 410 and the hub 560 of each propeller (each of which are optionally metal parts) from contact with the material being processed. Similarly, the outer lining 424 of the upper spacer 420 optionally cooperates with the axial core of the upper propeller 500*i* to substantially seal the shaft 410 and the hub 560 of the upper propeller 500*i* from contact with the material being processed. In some embodiments, a sealant or annular seal may be positioned around the abutments between the liners 424, 444 and the propellers in order to further seal the shaft and hubs from contact with materials being processed. With reference to FIG. 14, the outer lining 424 of the upper spacer 420 and the interior surface of lid 122 (which may include a lining such as urethane as described herein) optionally cooperate to seal (and/or substantially seal) the upper portion 415 of the shaft 410, the bushing 450 and the washer 452 from contact with the material (e.g., fluid, mixture of fluid and solid, slurry, etc.) being processed. Furthermore, the washer and bushing are optionally positioned outside the interior volume of the tank where materials are processed.

In other embodiments, a cap and/or gasket (either of which may be made of rubber) may be provided at the lower end of the shaft 410 to substantially seal the bolt 404 and/or washer 402 from contact with the materials being processed. In still other embodiments, the lower end of the shaft 410 may extend out of an opening in the lower surface of the tank 120 such that the bolt 404 and washer 402 are disposed outside of the interior volume of the tank; in such embodiments, the lower end of the shaft 410 optionally extends into a user-accessible region below the tank which may be formed by a skirt or footings arranged at the bottom of the tank.

The propeller shaft assembly 400 is optionally configured to be assembled by sliding propellers 500*i*, 500*ii* onto the shaft 410. The propeller shaft assembly 400 is optionally configured to be disassembled and at least partially rebuilt in a maintenance mode by sliding propellers 500*i*, 500*ii* off of the shaft 410 and replacing at least one of the propellers and/or spacers when rebuilding the shaft.

Referring to FIGS. 7 and 8, each propeller is optionally installed on the shaft by aligning an alignment feature of the propeller with an alignment feature of the shaft. The alignment features optionally comprise or hold in place a drive element having surfaces (e.g., contacting, radially extending surfaces) disposed to transfer a moment from the shaft to the propeller and thus drive the propeller for rotation. In the illustrated embodiment, the alignment feature of each propeller 500 comprises a keyway 564. The keyway 564 optionally comprises an elongated slot (e.g., a generally rectangular slot as illustrated) which may be formed in an internal surface of the hub 560 and optionally extends along the axial length of the hub 560. In the illustrated embedment, the shaft includes alignment features comprising keyways 411, 412 (which may also be described as key seats) located at the heights of the propellers 500*i*, 500*ii* respectively. The keyways 411, 412 optionally comprise elongated slots having a length substantially the same as the keyway 564. In the illustrated embodiment, a key (e.g., a length of metal stock optionally having a rectangular cross-section) is optionally inserted in each of the keyways 411, 412 such that when the propellers 500 are installed on the shaft 410, each key extends from the keyway 411, 412 into the keyways 564 of the propellers 500*i*, 500*ii*, respectively. The key optionally comprises a drive element with surfaces transmitting rotational (driving) forces from the shaft to the propeller. Thus in operation, rotation of the shaft 410 rotates the propellers 500 by applying a moment to the propellers via the keys and keyways.

In alternative embodiments, the key may be permanently or removably mounted (e.g., by welding or by fasteners) to the propellers and/or to the shaft. In alternative embodiments, the shaft may include one or more keyways and the propellers may include one or more corresponding key seats. In other alternative embodiments, the shaft and/or propeller may include a key (e.g., mounted thereto or formed as a part therewith) corresponding to a keyway or keyseat on the propeller and/or shaft, respectively.

Referring to FIG. 13, an injection actuator 170 (e.g., a valve such as a ball valve) optionally selectively injects water or other fluid from an inlet I into the tank 120 during operation and may be additionally configured to control a rate at which fluid enters the tank. In the illustrated embodiment, the injection actuator 170 comprises a ball valve in which a ball 172 has an opening which is selectively turned (e.g., by an electric motor of actuator 170) to selectively allow or prevent water supplied at the inlet I from entering the tank 120. An outlet nozzle 174 of the actuator 170 optionally changes and directs the flow of outlet water generally along an injection axis Ai. The nozzle 174 optionally extends through an opening in the lid 122 of the tank 120. It should be appreciated that in embodiments including a second attrition cell, the second attrition cell optionally includes a similar actuator 270.

In operation the material being processed will optionally form a vortex having an upper surface Sv. A radially inner height of the vortex surface Sv is optionally lower than a radially outer height of the vortex surface Sv. The nozzle 174 optionally directs injected water toward a position nearer to the radially inner portion of the vortex surface Sv than to the radially outer portion of the vortex surface Sv. The nozzle 174 optionally directs injected water toward a position adjacent to the shaft 410 and closer to the shaft 410 than the sidewall of the tank 120. The nozzle 174 optionally directs injected water toward a point on surface Sv having a height closer to the minimum height of the vortex surface Sv than the maximum height of the vortex surface Sv.

Figure 15:
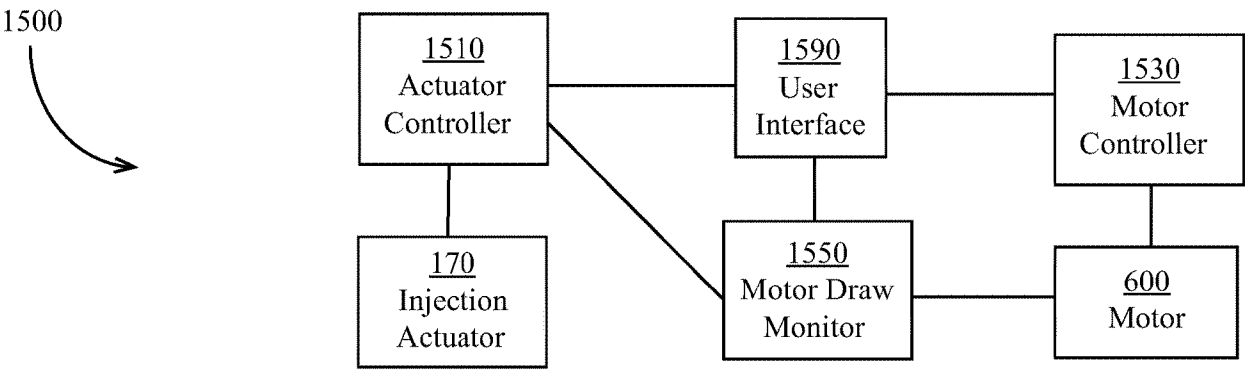
FIG. 15 schematically illustrates an embodiment of an attrition mill control and monitoring system.

Referring to FIG. 15, a control system 1500 is illustrated for controlling the injection actuator 170. The injection actuator 170 optionally comprises an electrically operated solenoid. An actuator controller 1510 (e.g., an electrical controller) is optionally in data communication with the injection actuator 170 for sending commands (e.g., electrical signals corresponding to an open, closed or a selected intermediate position of a ball valve) to the injection actuator 170. A motor draw monitor 1550 is optionally in data communication with the motor 600 for receiving motor draw information (e.g., power draw, current draw) from the motor 600. The motor draw monitor 1550 is optionally in data communication with the actuator controller 1510 for sending motor draw information and/or actuator controller commands to the actuator controller). The motor draw monitor 1550 may comprise a current draw measurement circuit (e.g., comprising an ammeter) configured to report the current drawn by the motor 600 to the actuator controller 1510. A motor controller 1530 (e.g., an electrical controller) is optionally in data communication with the motor 600 in order to send motor speed commands (e.g., a commanded rotational speed or current) to the motor 600.

In some embodiments, a user interface 1590 (optionally having a graphical user interface) is included in the system 1500 for receiving user input and displaying operational criteria to a user. The user interface 1590 may be in data communication with the motor controller 1530 for receiving motor speed to be displayed to the user and for sending motor speed commands to the motor controller 1530. The user interface 1590 may be in data communication with the motor draw monitor 1550 for receiving motor draw information (e.g., power draw, current draw) to be displayed to the user. The user interface 1590 may be in data communication with the actuator controller 1510 for sending actuator commands and/or receiving actuator condition criteria (e.g., on, off, or an injection flow rate).

As used herein, the term "data communication" may refer to electrical communication, electronic communication, wireless radio communication or other communication forms known in the art for transmitting commands or information.

Figure 16:
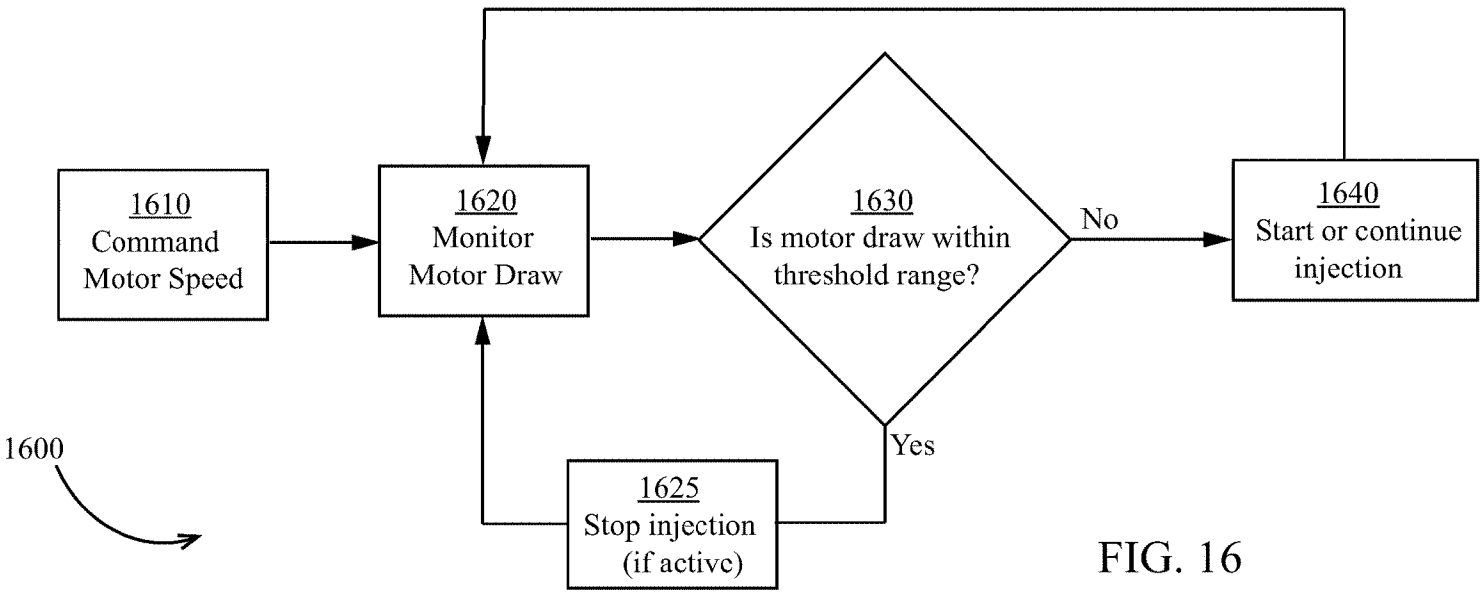
FIG. 16 schematically illustrates an embodiment of a process for controlling and monitoring an attrition mill.

Turning to FIG. 16, a process 1600 for controlling the injection actuator 170 (and thus a rate of injection of fluid such as water into the tank 120) is illustrated schematically. At step 1610, the system 1500 commands a motor speed to the motor 600 such that the shaft 410 begins to rotate. At step 1620, the system 1500 optionally monitors the motor draw (e.g., power draw, current draw) of the motor 600. At step 1630, the system 1500 (e.g., the actuator controller and/or the user interface) optionally determines whether the motor draw is within a threshold range which may be stored in memory. If the motor draw is not within the threshold range at step 1630, then at step 1640 the system 1500 optionally starts the injection (e.g., opens a valve). If the injection has already been started, then at step 1640 the system 1500 optionally continues the injection (e.g., does not close the valve). In some embodiments, if the injection has already been started, then at step 1640 the system 1500 increases a rate of injection (e.g., further opens a valve). If at step 1630 the motor draw is within the threshold range, then at step 1625 the system 1500 optionally stops the injection (e.g., closes the valve) if the injection was active, or simply does not start the injection (e.g., does not open the valve) if the injection was not active.

It should be appreciated that the system 1500 may be in data communication with a plurality of motors and injection actuators associated with a plurality of attrition cells and optionally independently controls fluid injection to each attrition cell.

Figure 4:
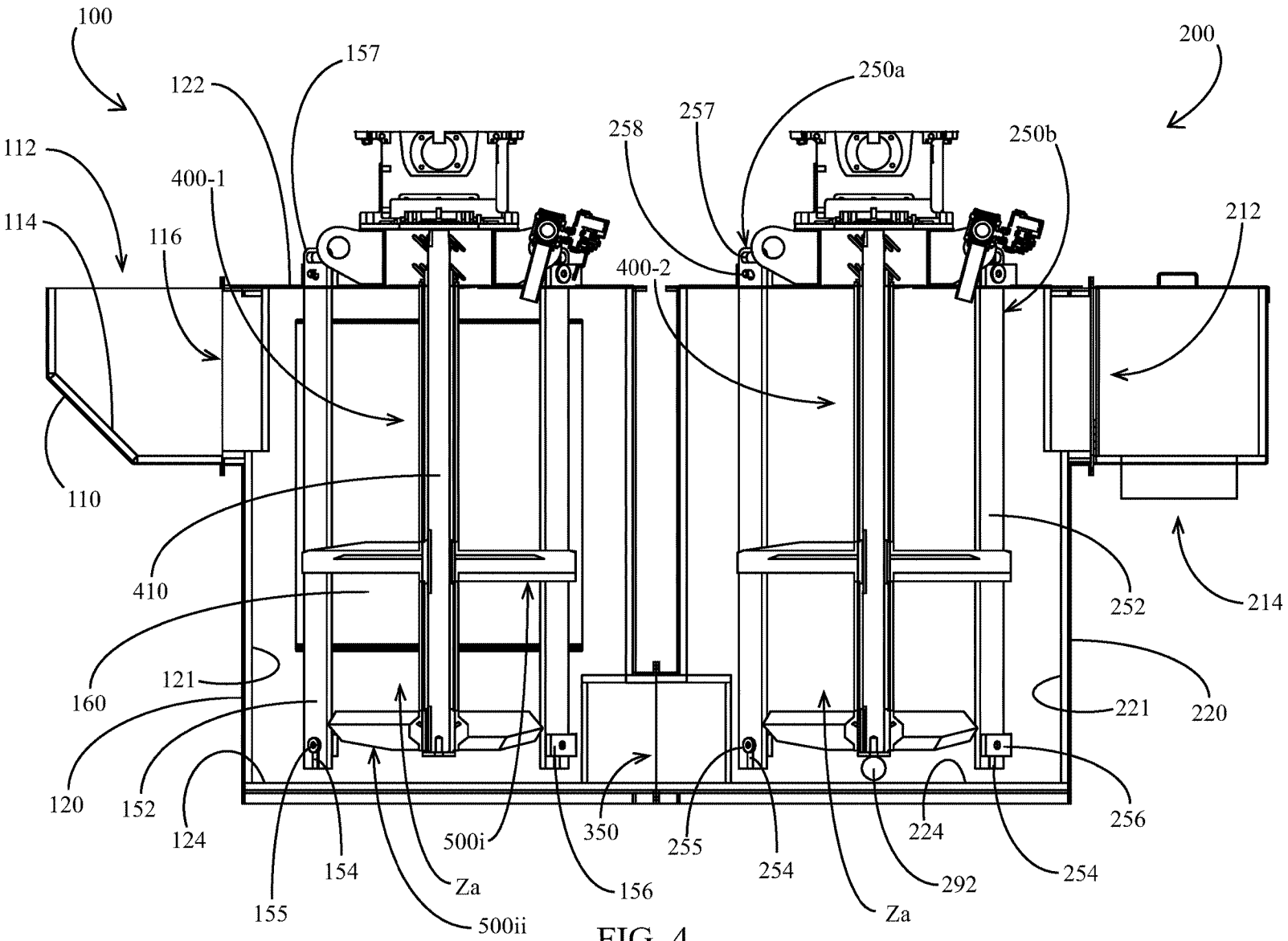
FIG. 4 is a sectional view of the attrition mill of FIG. 1 along the section 4-4 of FIG. 2.
Figure 5:
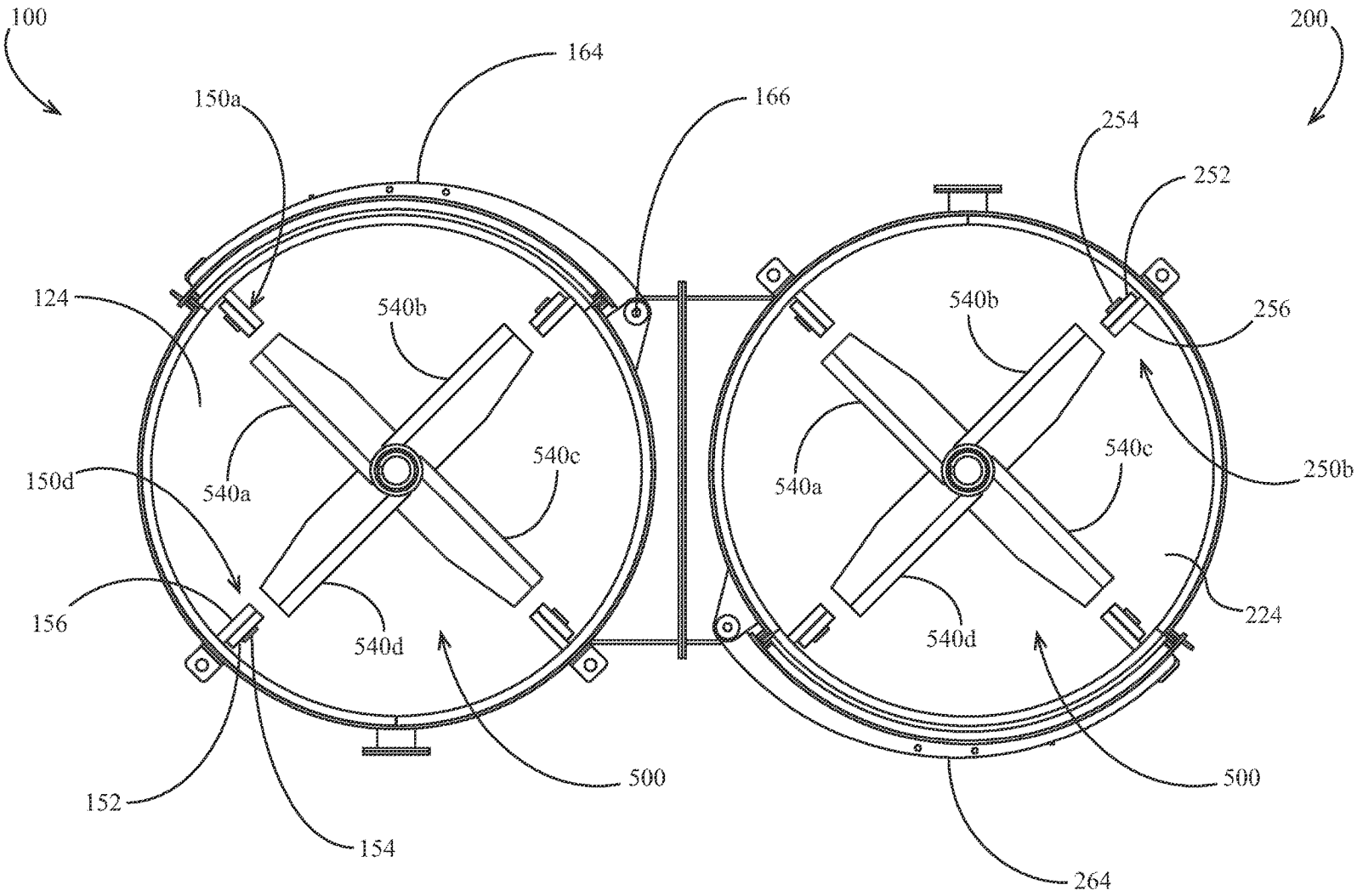
FIG. 5 is a sectional view of the attrition mill of FIG. 1 along the section 5-5 of FIG. 3.

Referring to FIGS. 4 and 5, the baffle assemblies 150 are optionally removable. The baffle assemblies 150 are optionally individually replaceable. The baffle assemblies 150 are optionally individually selectively removable and replaceable without the use of tools. In the illustrated embodiment, each baffle 152 is optionally at least partially slidingly received in an associated opening (e.g., a rectangular opening sized to receive the baffle 152) formed in the lid 122 In a manufacturing phase, the openings may be formed as a part of the lid or formed by removing material from the lid. The baffle 152 optionally includes a support structure 154 (e.g., a surface, a notch, a plurality of surfaces) formed in a lower portion thereof. In the illustrated embodiment, the notch is formed in a bottom surface of the baffle 152, but the support structure 154 may be located in other locations such as on a radially outer edge of the baffle 152 in other embodiments. The support structure 154 (e.g., notch) optionally includes sidewalls (e.g., the sides of a notch) for releasably engaging a support 155 (e.g., pin or bolt) optionally disposed inside the interior volume of the tank 120, optionally near the bottom surface 124 of the tank 120. In the illustrated embodiment, the support 155 is supported adjacent to the sidewall 121 of the tank 120 by a radially inwardly extending bracket 156. The support 155 may be threaded into an opening in the bracket 156 or welded to the bracket 156. The bracket 156 may be welded to the sidewall 121 of the tank 120. In the illustrated embodiment, the lower support 155 comprises a cylindrical portion and a head portion; the support structure 154 optionally extends around the cylindrical portion such that the sidewalls of the support structure are radially retained in position by the cylindrical portion. The head portion and the inwardly extending bracket 156 optionally cooperate to retain the baffle 152 in position (e.g., preventing the baffle from moving in the rotational direction of the propellers as processed material contacts the baffle surface). The support structure 154 is optionally releasable from the support 155 without the use of tools; for example, the support structure 154 may comprise a notch having an open lower end such that the support structure 154 may be freed from the support 155 by lifting the baffle 152 upward. It should be appreciated that the support structure 154 and support 155 cooperate to retain the baffle 152 in position, which function may but need not include supporting the weight of the baffle 152; in the illustrated embodiments the support 155 supports the weight of the baffle, but in other embodiments the baffle 152 may rest on the bottom surface 124 of the tank or other structure and the support structure 154 and support 155 may cooperate to retain the radial and/or angular position of the baffle 152. In embodiments including a second attrition cell, the second attrition cell optionally includes one or more baffles 252 supported at a lower end thereof by brackets 256; the baffles 252 may include support structure 254 releasably engaging a support 255 optionally mounted to bracket 256.

At a generally upper end of the baffle 152, the baffle 152 is optionally releasably mounted to a bracket 153. The bracket 153 is optionally disposed outside the interior volume of the tank 120 and may be mounted (e.g., by welding) to the lid 122 of the tank 120 as illustrated. A removable attachment 158 (e.g., a generally cylindrical structure such as a pin, key or bolt) optionally releasably secures the upper end of the baffle 152 to the bracket 153 by extending at least partially through openings (e.g., round openings) in both the upper end of the baffle 152 and the bracket 153. The attachment 158 may be releasably secured to bracket 153 by threading or by a removable locking device (not shown) such as a hitch pin. A handle 157 is optionally provided in the upper end of the baffle 152 for lifting the handle.

In an installation phase, a user optionally lowers the baffle 152 downward (e.g., using handle 157) through the opening in the lid 122 until the support structure 154 engages the support 155 and/or bracket 153. The user then optionally secures the baffle 152 to the upper bracket 153, optionally using the attachment 158. In a removal and/or inspection phase, the user optionally removes the attachment 158 and lifts the baffle 152 upward to disengage the support structure 154 from the support 155 and remove the baffle partially or completely from the tank 120.

The baffle assemblies 250*a*, 250*b*, 250*c*, 250*d* of the tank 220 are optionally also removable and optionally generally similar to the baffle assemblies 150 described above.

Figure 1:
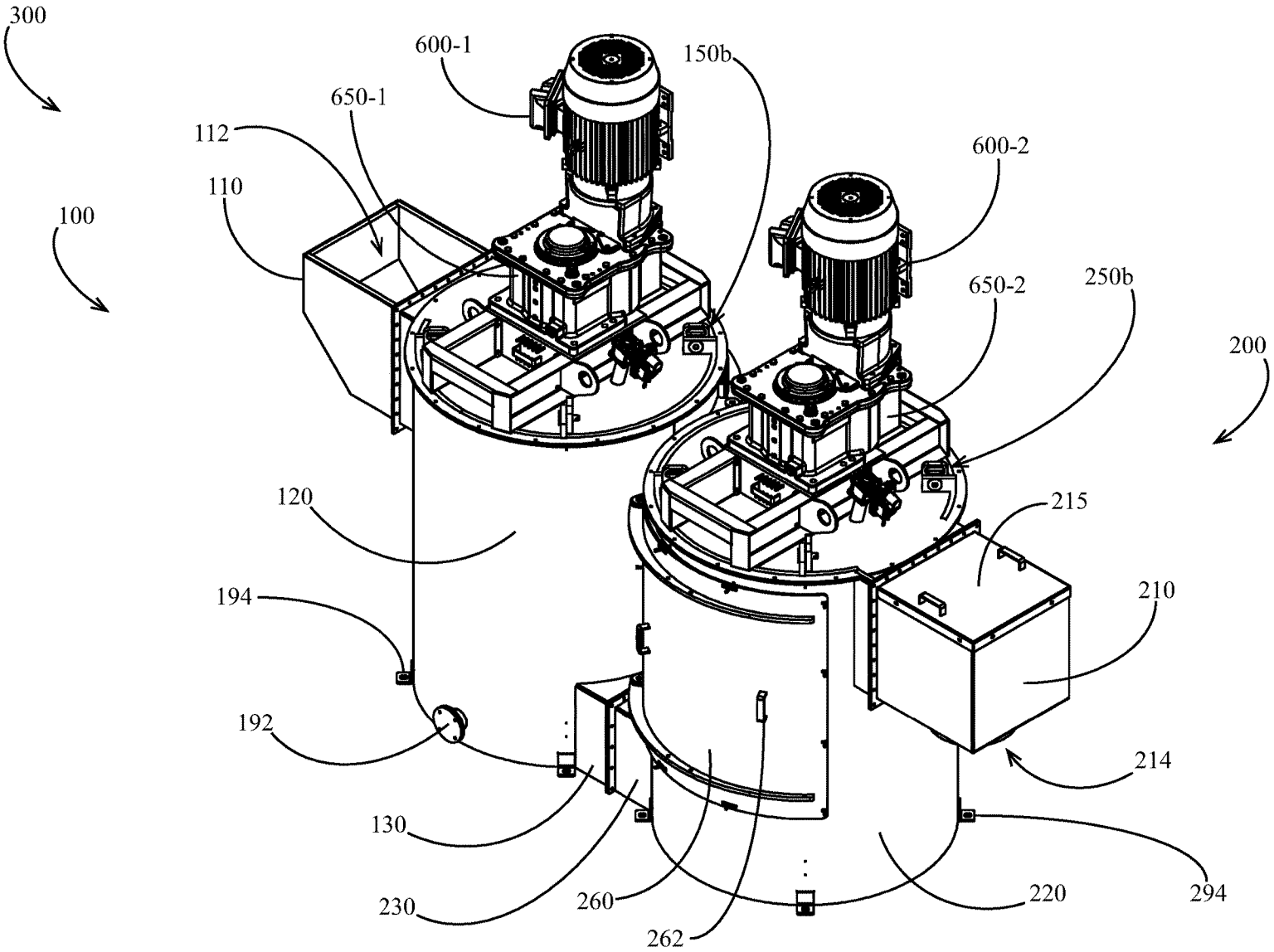
FIG. 1 is a perspective view of an embodiment of an attrition mill.
Figure 2:
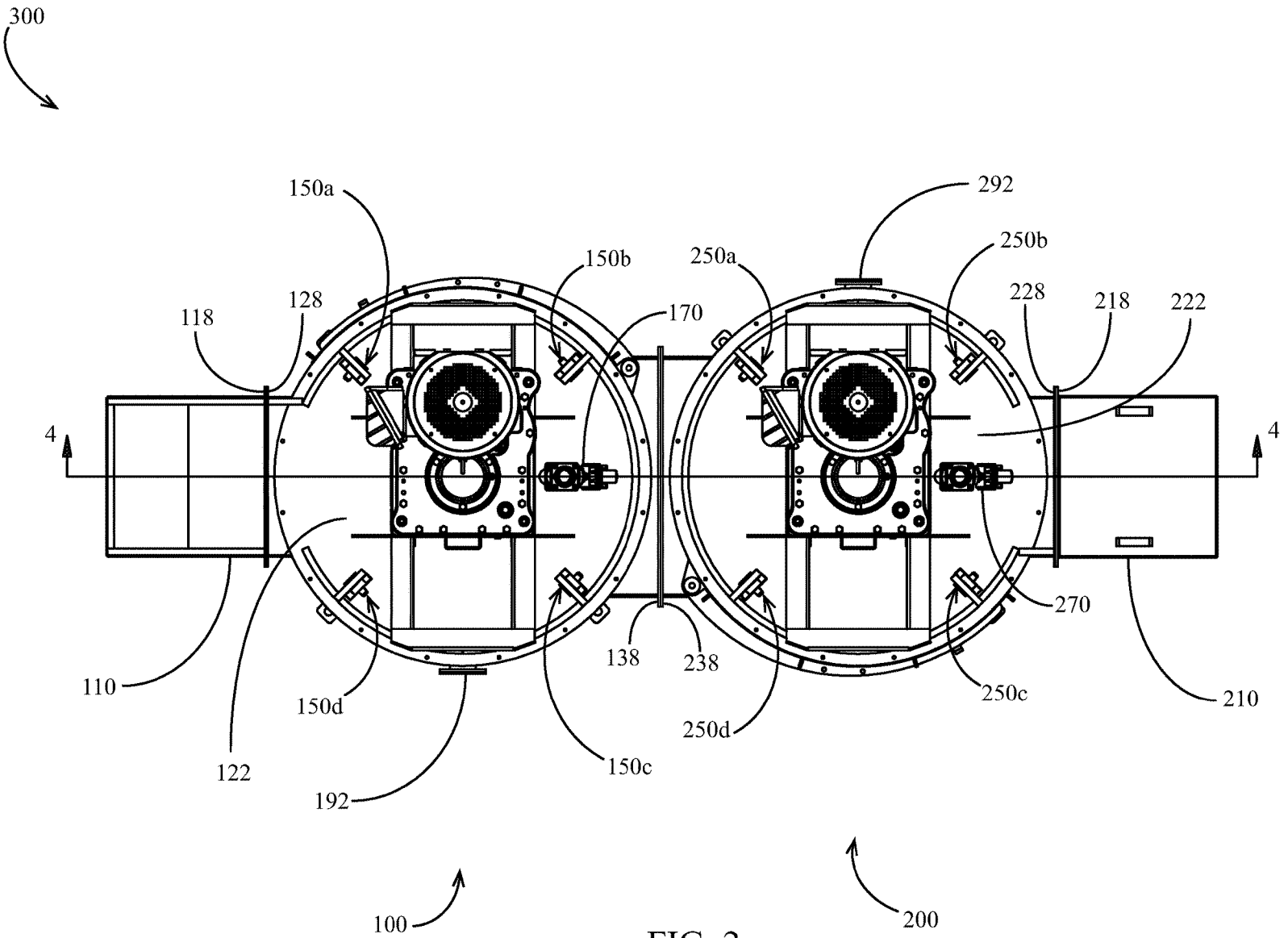
FIG. 2 is a plan view of the attrition mill of FIG. 1.
Figure 3:
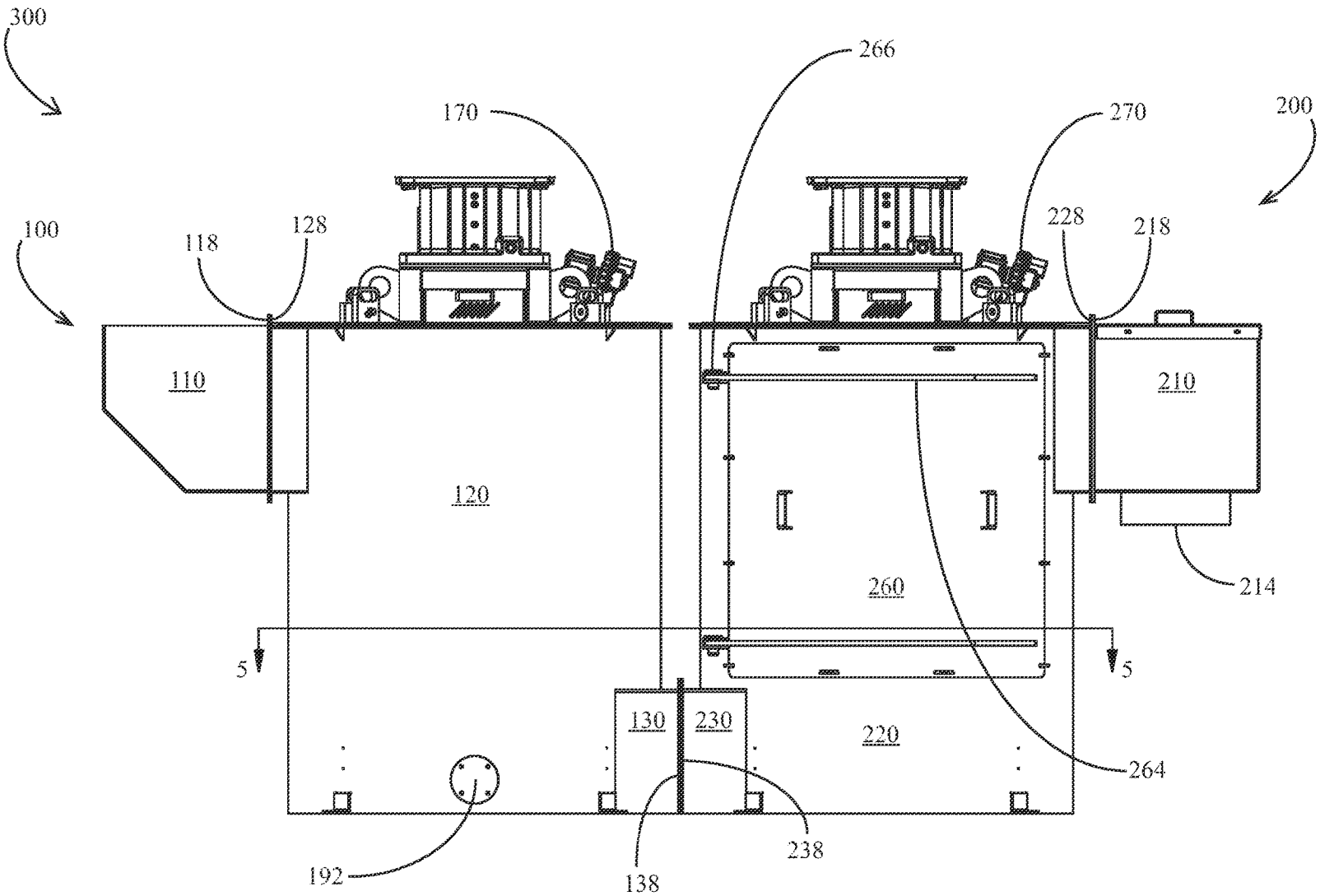
FIG. 3 is a side elevation view of the attrition mill of FIG. 1.

Referring to FIG. 1, drains 192 are optionally disposed near the bottom of the sidewall of each tank 120. Each drain 192 is optionally selectively openable to release material from the tank 120. Each drain 192 optionally includes a flat plate releasably fastened (e.g., by bolts) to a flange provided on the tank 120. Each drain 192 optionally includes a gasket sealing material within the tank when the drain is closed. Embodiments including a second attrition sell optionally include a second drain 292 formed in the second attrition cell.

Continuing to refer to FIG. 1, a hopper access door 215 is optionally removably mounted (e.g., by bolts) to the outlet hopper 210 to provide access to the interior volume of the outlet hopper and any materials contained therein. The hopper access door 215 is optionally mounted to an upper end of the outlet hopper 210 as illustrated such that removal of the hopper access door 215 allows access to and inspection of materials in the outlet hopper 210 without allowing the materials to escape the hopper by gravity or by system pressure. The hopper access door 215 may alternatively comprise a hinged or sliding gate movably mounted to the outlet hopper 210.

Referring to FIGS. 1 and 5, tanks 120, 220 each optionally include an access door 160, 260, respectively. Each access door is optionally disposed on a sidewall of the tank and is optionally displaceable (e.g., pivotable, slidable, removable, etc.) for inspecting the interior volume of the tank and/or removing components from the interior volume of the tank. The access doors 160, 260 optionally pivot relative to the associated tank about hinges 166, 266, respectively, which may be linked to support struts 164, 264, respectively, which may be mounted to an outer surface of each access door. The access doors 160, 260 can optionally be manipulated by the user by use of handles 162, 262, respectively, which are optionally provided on each access door. A latching mechanism optionally selectively retains the doors in a closed position.

In some embodiments, a hatch opening in the tank sidewalls which is closed and opened by each access door 160, 260 is sized to permit removal of one or more propellers 500 from the tank; for example, the hatch opening may have a height, width or diagonal measurement greater than a total length Li (see FIG. 13) of the propeller 500 (e.g., twice the length of the propeller blades 540 plus the diameter of the axial core 570). In some embodiments, the hatch opening is sized and positioned on the tank sidewalls to permit removal of the propeller shaft assembly 400 once the propeller shaft assembly is decoupled from the motor 600 and/or gearbox 650. For example, a height of an upper edge of the hatch opening relative to the bottom surface 124 of the tank may be greater than the total height of the shaft 410 (and/or the height of the shaft when the assembly 400 is placed on the bottom surface 124). The height of the upper edge relative to the bottom surface 124 may be selected such that the shaft 410 (and/or the entire propeller shaft assembly 400) can be tipped inside the tank 120 to move the upper portion 415 of the shaft beneath the upper edge and out of the tank 120 in order to extract the shaft 410 (and/or assembly 400) from the tank.

Any ranges recited herein are intended to inclusively recite all values within the range provided in addition to the maximum and minimum range values.

Although various embodiments have been described above, the details and features of the disclosed embodiments are not intended to be limiting, as many variations and modifications will be readily apparent to those of skill in the art. Accordingly, the scope of the present disclosure is intended to be interpreted broadly and to include all variations and modifications within the scope and spirit of the appended claims and their equivalents. For example, any feature described for one embodiment may be used in any other embodiment.

The invention claimed is:

1. An attrition mill, comprising:

a tank, said tank having a sidewall defining an interior volume, said sidewall positioned between a lid and a bottom surface of said tank;

an inlet in fluid communication with said interior volume;

an outlet in fluid communication with said interior volume, said outlet vertically displaced from said inlet;

a motor;

a shaft assembly, said shaft assembly comprising:

a shaft, said shaft being removably coupled to said motor, said shaft being operably coupled to said motor for rotation of said shaft about a vertical axis, said shaft extending along the vertical axis through an opening in the lid toward the bottom surface and terminating at an end spaced apart from the bottom surface, wherein the lid supports the shaft for rotation about the vertical axis and the end is free of support for rotation about the vertical axis;

a first propeller, said first propeller comprising a first axial core having a first axially extending outer wall, said first propeller comprising a first plurality of propeller blades mounted to said first axial core, said first propeller removably mounted to said shaft, said first propeller disposed at a first height;

a second propeller disposed at a second height along said shaft, said second height being higher than said first height;

a first spacer disposed between said first propeller and said second propeller, said first spacer removably covering a first portion of said shaft, said first spacer abutting said first axial core of said first propeller; and a second spacer disposed between said second propeller and said opening, said second spacer removably covering a second portion of said shaft, wherein at least one of said spacers at least partially supports at least one of said propellers an access opening in said sidewall of said tank;

an access door displaceably mounted to said tank, said access door having a first position in which said access opening is covered by said access door, said access door having a second position in which said access opening is not covered by said access door, wherein said access opening is sized such that at least one of said first and second propellers is removable from said tank through said access opening.

2. The attrition mill of claim 1, wherein said second propeller is removably retained on said shaft assembly.

3. The attrition mill of claim 1, wherein said first propeller, said second propeller, said first spacer and said second spacer cooperate to prevent material in said interior volume from contacting said shaft.

4. The attrition mill of claim 1, wherein said second spacer extends at least partially through said opening.

5. The attrition mill of claim 1, wherein first spacer is supported at least partially by said first propeller.

6. The attrition mill of claim 1, wherein said second propeller is supported at least partially by said first spacer.

7. The attrition mill of claim 1, wherein said second spacer is supported at least partially by said second propeller.

8. The attrition mill of claim 1, wherein said first spacer rests on said first propeller.

9. The attrition mill of claim 8, wherein said second propeller rests on said first spacer.

10. The attrition mill of claim 1, wherein at least one of said first and second spacers comprises a shell made of a first material and a lining made of a second material.

11. The attrition mill of claim 1, wherein an annular gap is disposed between said shaft and at least one of said first and second spacers.

12. The attrition mill of claim 1, wherein one of said shaft and said second propeller includes a keyway, and wherein the other of said shaft and said second propeller includes a keyseat, wherein a key engages said keyway to said keyseat such that rotation of said shaft causes rotation of said second propeller.

13. The attrition mill of claim 1, wherein said access opening is sized such that said shaft assembly is removable from said tank through said access opening.

14. The attrition mill of claim 1, further comprising:

a bushing mounted to said shaft, said bushing disposed at or near an upper end of said shaft, said bushing being disposed at least partially outside of said tank.

15. The attrition mill of claim 1, wherein an annular gap is disposed between said shaft and said second spacer, and wherein said bushing extends at least partially into said annular gap.

16. An attrition mill, comprising:

a tank, said tank having a sidewall defining an interior volume, said sidewall positioned between a lid and a bottom surface of said tank;

an inlet in fluid communication with said interior volume;

an outlet in fluid communication with said interior volume, said outlet vertically displaced from said inlet;

a motor;

a shaft assembly, said shaft assembly comprising:

a shaft made of a first material, said shaft being removably coupled to said motor, said shaft being operably coupled to said motor for rotation of said shaft about a vertical axis, said shaft extending along the vertical axis through an opening in the lid toward the bottom surface and terminating at an end spaced apart from the bottom surface, wherein the lid supports the shaft for rotation about the vertical axis and the end is free of support for rotation about the vertical axis;

a first propeller removably mounted to said shaft, said first propeller disposed at a first height;

a second propeller comprising an axially extending core and a plurality of propeller blades attached to said axially extending core, said second propeller disposed at a second height along said shaft, said second propeller being removably supported on said shaft, said second height being higher than said first height;

a spacer disposed between said first and second propeller and at least partially supported by said first propeller, said axially extending core of said second propeller resting on said spacer; and a lining made of a second material, said lining applied to said spacer, wherein said lining protects said spacer from contact with fluid in said interior volume; and an access opening in said sidewall of said tank;

an access door displaceably mounted to said tank, said access door having a first position in which said access opening is covered by said access door, said access door having a second position in which said access opening is not covered by said access door, wherein said access opening is sized such that at least one of said first and second propellers is removable from said tank through said access opening.

17. The attrition mill of claim 16, wherein said second propeller comprises a blade, said blade having an inner end and an outer end, said inner end having an inner end height, said outer end having an outer end height, said blade having an upper surface, said upper surface having a chamfer such that said outer end height is less than said inner end height.

18. The attrition mill of claim 16, further comprising:

a baffle slidingly received in an opening in a lid of said tank, said tank extending vertically substantially along an inner sidewall of said tank.

19. The attrition mill of claim 1, wherein at least one of said propeller blades is disposed at an angle At with respect to horizontal.

20. The attrition mill of claim 19, wherein said angle At is 45 degrees.

21. The attrition mill of claim 19, wherein said angle At is approximately 40 degrees.

22. The attrition mill of claim 19, wherein said angle At is less than 45 degrees.

23. The attrition mill of claim 1, wherein said tank is generally cylindrical, and wherein said access door is arcuately shaped.

24. The attrition mill of claim 16, wherein at least one of said propeller blades is disposed at an angle At with respect to horizontal.

25. The attrition mill of claim 24, wherein said angle At is 45 degrees.

26. The attrition mill of claim 25, wherein said angle At is approximately 40 degrees.

27. The attrition mill of claim 16, wherein said tank is generally cylindrical, and wherein said access door is arcuately shaped.

* * * * *